US006642815B2

(12) United States Patent
Okazaki et al.

(10) Patent No.: US 6,642,815 B2
(45) Date of Patent: Nov. 4, 2003

(54) DIELECTRIC RESONATOR FILTER

(75) Inventors: Yasunao Okazaki, Shiga (JP); Michio Okajima, Osaka (JP); Akira Enokihara, Nara (JP); Toshiaki Nakamura, Nara (JP); Minoru Tachibana, Osaka (JP); Kunihiko Minami, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/218,285

(22) Filed: Aug. 14, 2002

(65) Prior Publication Data

US 2002/0190819 A1 Dec. 19, 2002

Related U.S. Application Data

(62) Division of application No. 09/864,020, filed on May 23, 2001.

(30) Foreign Application Priority Data

May 23, 2000 (JP) ..... 2000-150964

(51) Int. Cl.[7] ..... H01P 7/10
(52) U.S. Cl. ..... 333/202; 333/235
(58) Field of Search ..... 333/202, 219, 333/235, 208, 209, 211

(56) References Cited

U.S. PATENT DOCUMENTS 4,028,652 A * 6/1977 Wakino et al. ..... 333/209
4,138,652 A * 2/1979 Nishikawa et al. ..... 333/219.1
4,143,344 A * 3/1979 Nishikawa et al. ..... 333/202
4,335,365 A 6/1982 Pome
4,692,723 A * 9/1987 Fiedziuszko et al. ..... 333/202
4,896,125 A 1/1990 Blair, Jr. et al.
5,612,655 A 3/1997 Stronks et al.
5,777,534 A * 7/1998 Harrison ..... 333/202
5,841,330 A 11/1998 Wenzel et al.

FOREIGN PATENT DOCUMENTS

FR 2 512 279 3/1983
JP 08065006 A 3/1996
JP 2000114809 A 4/2000

OTHER PUBLICATIONS

Wang, Chi et al.; "Mixed Modes Cylindrical Planar Dielectric Resonator Filters with Rectangular Enclosure"; IEEE Transactions on Microwave Theory and Techniques; Dec. 1995; No. 12, Part 2, New York, US; pp. 2817–2823.

* cited by examiner

*Primary Examiner*—Seungsook Ham
(74) *Attorney, Agent, or Firm*—Harness, Dickey & Pierce, P.L.C.

(57) ABSTRACT

A dielectric resonator filter comprises dielectric resonators, an enclosure having a main body, a lid, and partition walls, interstage-coupling tuning windows, interstage-coupling tuning bolts, input/output terminals, and input/output coupling probes. Resonance-frequency tuning members each composed of a conductor plate and a bolt coupled integrally thereto are attached to the enclosure lid. Undesired-mode suppressing means such as rings attached to the bolts of the resonance-frequency tuning members or bolts attached to the conductor plates or to the enclosure lid are disposed in an undesired-mode excitation space, whereby the occurrence of a disturbed characteristic in the pass band (or stop band) is suppressed.

11 Claims, 26 Drawing Sheets

DIELECTRIC RESONATOR FILTER

CROSS-REFERENCE TO RELATED APPLICATIONS

This application is a divisional of U.S. patent application Ser. No. 09/864,020 filed on May 23, 2001 entitled "Dielectric Resonator Filter" and also claims priority to Japanese Patent Application No. 2000-150,964 filed on May 23, 2000.

BACKGROUND OF THE INVENTION

The present invention relates to a multi-purpose dielectric resonator filter for use at a mobile communication base station to serve as each of a receiving filter, a transmitting filter, a duplexer, and the like.

Conventionally, band pass filters for allowing the passage of only signals in a specified frequency band have been used at base stations for mobile communication such as a mobile phone. For example, a receiving system uses a receiving filter to remove signals for communication systems using the other frequency bands and a transmitting system uses a transmitting filter not to send undesired electric waves to the systems using the other frequency bands. Such filters for use at the base stations are required to have a sufficiently low loss to provide the base stations with an adequate receiving sensitivity and power efficiency, a sharp filter characteristic provided for a reduced interval in frequency band between the adjacent base stations, and reduced size and weight for easier mounting on the overheads of the base stations. As an example of a filter satisfying such requirements, a dielectric resonator filter composed of a plurality of dielectric resonators coupled to each other has been proposed, which comes in various configurations.

FIG. 21 is a perspective view schematically showing an example of a conventional six-stage dielectric resonator filter. As shown in FIG. 21, the conventional dielectric resonator filter comprises six cylindrical dielectric resonators 511A to 511F formed by sintering a dielectric powder material. The resonance frequency of each of the dielectric resonators 511A to 511F is determined by the height and diameter of the cylindrical configuration thereof. In this example, the six dielectric resonators 511A to 511F operate as a six-stage band pass filter. An enclosure 520 of the dielectric resonator filter comprises a main body 521 composed of a bottom wall and side walls, a lid 522, partition walls 523A to 523G connected to each other to partition, into chambers, a space enclosed by the enclosure main body 521. The dielectric resonators 511A to 511F are disposed on a one-by-one basis in the respective chambers defined by the partition walls 523A to 523G of the enclosure 520. Interstage-coupling tuning windows 524A to 524E for providing electromagnetic field couplings between the resonators are provided between the five partition walls 523A to 523E of the seven partition walls 523A to 523G and the side walls of the enclosure main body 521. The interstage-coupling tuning windows 524A to 524E are provided with respective interstage-coupling tuning bolts 531A to 531E each for tuning the strength of an electromagnetic field coupling between the resonators. The enclosure main body 521 is provided with input/output terminals 541 and 542 each composed of a coaxial connector to input and output a high-frequency signal to and from the outside. Input/output coupling probes 551 and 552 are connected to the respective core conductors of the input/output terminals 541 and 542.

Resonance-frequency tuning members 561A to 561F each composed of a disk and a bolt formed integrally to tune the resonance frequency of the corresponding one of the dielectric resonators 511A to 511F are attached to the enclosure lid 521. The resonance-frequency tuning members 561A to 561F are disposed to have their respective center axes at the same plan positions as the respective center axes of the dielectric resonators 511A to 511F (i.e., at the concentric positions).

Since the frequency characteristics including passband width and attenuation characteristic of a dielectric resonator filter are generally determined by the resonance frequency and Q factor of each of the resonators and an amount of coupling between the individual dielectric resonators, the configuration and the like of each of the dielectric resonators are calculated from the specifications of the frequency characteristics of the filter at the design stage. In practice, however, filter characteristics as designed cannot be obtained due to an error in the configurations of the dielectric resonators and enclosure and to a mounting error. To provide filter characteristics as designed, the resonance-frequency tuning members 561A to 561F are provided in the conventional dielectric resonator filter to render the respective resonance frequencies of the dielectric resonators 511A to 511F variable. In addition, the interstage-coupling tuning bolts 531A to 531E are provided to render the strengths of interstage couplings variable. Through the tuning using the tuning mechanism, desired filter characteristics are provided.

For the resonance-frequency tuning members 561A to 561F, a structure as shown in FIG. 21 has been used widely in which the frequency characteristics of the dielectric resonators 511A to 511F are made variable by tuning the distance between conductor plates opposed to the dielectric resonators 511A to 511F and the dielectric resonators 511A to 511F by using the bolts.

The dielectric resonator filter having such a structure operates as follows. If a high-frequency signal transmitted from, e.g., a signal source or an antenna and inputted into the enclosure 520 via the input/output terminal 541 has a frequency within the pass band of the filter, the signal couples to an electromagnetic field mode in the input-stage dielectric resonator 511A by the effect of the input/output coupling probe 551 so that TE01δ as a basic resonance mode is excited.

The resonance mode couples to respective electromagnetic field modes in the subsequent dielectric resonators 511B, 511C, . . . in succession through the interstage-coupling tuning windows 524A, 524B, . . . so that the electromagnetic field mode excited in the dielectric resonator 511F couples to the output-side input/output probe 552 and the high-frequency signal is outputted from the input/output terminal 542. On the other hand, the high-frequency signal having a frequency outside the pass band of the filter is reflected without coupling to the resonance mode in the dielectric resonator and sent back from the input/output terminal 541.

FIG. 24 is a perspective view schematically showing an example of a conventional four-stage dielectric resonator filter. As shown in FIG. 24, the conventional dielectric resonator filter comprises four cylindrical dielectric resonators 611A to 611D formed by sintering a dielectric powder material. In this example, the four dielectric resonators 611A to 611D operate as a four-stage band pass filter. An enclosure 620 of the dielectric resonator filter comprises a main body 621 composed of a bottom wall and side walls, a lid 622, and partition walls 623A to 623D connected to each other to partition, into chambers, a space enclosed by the enclosure main body 621. The dielectric resonators 611A to 611D are disposed on a one-by-one basis in the respective chambers defined by the partition walls 623A to 623D of the enclosure 620. Interstage-coupling tuning windows 624A to 624C for providing electromagnetic field couplings between the resonators are provided between the three partition walls 623A to 623C of the four partition walls 623A to 623D and the side walls of the enclosure main body 621. The interstage-coupling tuning windows 624A to 624C are provided with respective interstage-coupling tuning bolts 631A to 631C each for tuning the strength of an electromagnetic field coupling between the resonators. The enclosure main body 621 is provided with input/output terminals 641 and 642 each composed of a coaxial connector to input and output a high-frequency signal to and from the outside. Input/output coupling probes 651 and 652 are connected to the respective core conductors of the input/output terminals 641 and 642.

Resonance-frequency tuning members 661A to 661D each composed of a disk and a bolt formed integrally to tune the resonance frequency of the corresponding one of the dielectric resonators 611A to 611D are attached to the enclosure lid 621. The resonance-frequency tuning members 661A to 661D are disposed to have their respective center axes at the same plan positions as the respective center axes of the dielectric resonators 611A to 611D (i.e., at the concentric positions).

However, the foregoing conventional dielectric resonator filters have the following drawbacks.

FIG. 23 shows an example of the frequency characteristic of the dielectric resonator filter shown in FIG. 21. In FIG. 23, the horizontal axis represents the frequency (GHz) and the vertical axis represents the transmission characteristic (dB). As can be seen from the drawing, an attenuation pole P1 (valley) with an enhanced transmission characteristic exists in the pass band, which indicates that the filter characteristic has been degraded. The present inventors have assumed the cause of such a degraded filter characteristic as follows.

FIG. 22 shows an electromagnetic field mode in the vicinity of the conductor plate of each of the resonance-frequency tuning members 561 of the dielectric resonator filter shown in FIG. 21. In the drawing is shown the result of analyzing the distribution of an electric field in a cross section passing through the axis of the resonance-frequency tuning member by an electromagnetic field simulation using a FDTD method. As shown in FIG. 22, a spurious electromagnetic field mode is produced in a space defined by the conductor plate of the resonance-frequency tuning member 561 and the enclosure lid 522.

As a result, the spurious electromagnetic field mode couples to a high-frequency signal to cause the state of resonance so that the spurious attenuation pole P1 (valley portion) is assumed to appear in the frequency characteristic. The spurious mode reacts more sensitively to the movement of the resonance-frequency tuning member than the resonance frequency in a basic mode required to provide the filter characteristic and changes greatly. Consequently, the attenuation pole resulting from the spurious mode frequently passes through a near-passband region when the vertical position of the resonance-frequency tuning member is changed to tune the filter characteristic and disturb the waveform of the filter characteristics, which presents a large obstacle to the tuning operation. In the worst case, the spurious mode enters the pass band of the filter even after the resonance-frequency tuning operation is completed to degrade the filter characteristic, as shown in FIG. 23.

In addition, the conventional dielectric resonator filters have the problem that a coupling between high-order modes different from the basic resonance mode in the dielectric resonators causes an undesired harmonic component at frequencies higher than the pass band of the filter. In principle, a component at a frequency higher than the pass band is removed by a low pass filter. However, there is an upper limit to the level of a signal that can be removed by the low pass filter. Therefore, strict specifications have been determined for the harmonic component in addition to the specifications of the pass band of a filter used at a base station of a mobile phone to suppress the level of the harmonic component.

FIG. 25 shows an example of the frequency characteristic of the conventional four-stage dielectric resonator filter. As shown in the drawing, a harmonic component on a level that cannot be removed completely by a low pass filter (e.g., −40 dB or more) may be produced in the conventional dielectric resonator filter. The present inventors have considered that the cause thereof is an insufficient capability of tuning the interstage couplings.

SUMMARY OF THE INVENTION

It is therefore a first object of the present invention to facilitate the operation of tuning a dielectric resonator filter and providing a dielectric resonator filter with an excellent frequency characteristic by focusing attention on the fact that the cause of the degraded characteristic in the conventional dielectric resonator filters is the spurious mode produced between the resonance-frequency tuning member as a mechanism for tuning the filter characteristic and the wall surface of the enclosure and providing means for eliminating the spurious mode.

A second object of the present invention is to provide a dielectric resonator filter with an excellent frequency characteristic and a wide range of tuning by providing means for suppressing the level of the harmonic component in the filter characteristic.

A first dielectric resonator filter according to the present invention comprises: at least one dielectric resonator; an enclosure enclosing the dielectric resonator to function as a shield against an electromagnetic field; resonance-frequency tuning means including a conductor plate disposed in a space enclosed by the enclosure to have a first surface opposed to a surface of the dielectric resonator and a second surface opposed to an inner surface of the enclosure, the resonance-frequency tuning means being capable of changing a distance between the conductor plate and the dielectric resonator; and spurious-mode suppressing means for suppressing propagation of a spurious electromagnetic field mode produced in a space between the second surface of the conductor plate and the inner surface of the enclosure.

The arrangement suppresses the propagation of an spurious electromagnetic field mode produced between the second surface of the conductor plate of the resonance-frequency tuning means and the inner surface of the enclosure and allows easy tuning of the filter characteristic which prevents the occurrence of a disturbed characteristic due to the spurious electromagnetic field mode in the pass band (or stop band) of the frequency characteristic of the dielectric resonator filter.

The spurious-mode suppressing means is a spurious-mode suppressing member filling a part of the space between the second surface of the conductor plate and the inner surface of the enclosure. The arrangement suppresses the occurrence of a disturbed characteristic in the pass band (or stop band) by the effects of reducing the guide wavelength of the spurious mode excited in the space and shifting the spurious mode toward higher frequencies.

The resonance-frequency tuning means further includes a bolt for changing the distance between the conductor plate and the dielectric resonator and the spurious-mode suppressing member is composed of a ring having a screw hole for engagement with the bolt. The arrangement allows effective suppression of the spurious mode with a simple structure.

If the spurious-mode suppressing means is a rod supported by either of the conductor plate and the enclosure to fill the part of the space defined by the second surface of the conductor plate and the inner surface of the enclosure, similar effects are achievable.

The spurious-mode suppressing member is composed of a conductor material or a dielectric material. The arrangement achieves the effect of reflecting an electromagnetic wave and allows effective suppression of the spurious mode.

The spurious-mode suppressing means is composed of a resistor element having a surface portion exposed in the space between the second surface of the conductor plate and the inner surface of the enclosure to function as an electric resistor against a high-frequency induction current flowing along the surface portion. The arrangement attenuates the spurious electromagnetic field mode in the space and suppresses the amplitude level of the spurious mode, so that the occurrence of a disturbed characteristic in the pass band (or stop band) is suppressed.

A second dielectric resonator filter according to the present invention comprises: a plurality of dielectric resonators; an enclosure enclosing the plurality of dielectric resonators to function as a shield against an electromagnetic field; and a plurality of resonance-frequency tuning means provided on a one-by-one basis for the plurality of dielectric resonators, each of the plurality of resonance-frequency tuning means including a conductor plate disposed in a space enclosed by the enclosure to have a first surface opposed to a surface of the corresponding one of the dielectric resonators and a second surface opposed to an inner surface of the enclosure, the resonance-frequency tuning means being capable of changing distances between the conductor plates and the dielectric resonators, the conductor plate of at least one of the plurality of resonance-frequency tuning means having a size different from sizes of the conductor plates of the other resonance-frequency tuning means.

If a tuning is made by increasing the diameter or thickness of the conductor plate of each of the resonance-frequency tuning means provided additionally on some of the dielectric resonators, the frequency in the spurious mode changes with the size of the conductor plate. By using this, the disturbed characteristic resulting from the spurious mode can be moved from the pass band (or stop band) to another frequency region, so that the occurrence of a disturbed characteristic in the pass band (or stop band) is suppressed.

Preferably, the conductor plate of each of the resonance-frequency tuning means has a disk-shaped configuration.

A third dielectric resonator filter according to the present invention comprises: a plurality of dielectric resonators including an input-stage dielectric resonator for receiving a high-frequency signal from an external device and an output-stage dielectric resonator for outputting the high-frequency signal to an external device; an enclosure enclosing the plurality of dielectric resonators to function as a shield against an electromagnetic field; input coupling means for coupling the inputted high-frequency signal and an electromagnetic field in the input-stage dielectric resonator; output coupling means for coupling the outputted high-frequency signal and an electromagnetic field in the output-stage dielectric resonator; and an interstage-coupling tuning plate provided between those of the plurality of dielectric resonators having their respective electromagnetic fields coupled to each other to tune a strength of the electromagnetic field coupling, at least one of both side surfaces of the interstage-coupling tuning plate having a cutaway portion provided therein.

With the cutaway portion provided at the position at a higher current density and the like, the arrangement can enhance the filtering function with respect to frequencies higher than the pass band (or stop band) depending on the distribution of a current along the interstage-coupling tuning plate.

The cutaway portion in the interstage-coupling tuning plate may have a generally rectangular configuration but preferably has a generally rectangular configuration having a longer side disposed to be nearly parallel to a bottom surface of the enclosure.

Preferably, the cutaway portion in the interstage-coupling tuning plate is disposed such that a vertical position of the enclosure is nearly coincident with positions at which the dielectric resonators are disposed and formed to be in contact with an inner side surface of a wall composing an outer circumferential portion of the enclosure.

The third dielectric resonator filter according to the present invention further comprises an interstage-coupling tuning member disposed in the enclosure to protrude toward the cutaway portion in the interstage-coupling tuning plate, whereby the range of tuning of the interstage-coupling tuning members is widened.

Each of the plurality of dielectric resonators is a TE01δ-mode resonator, whereby the effects of the present invention are achieved remarkably.

A method for suppressing a spurious mode in a dielectric resonator filter comprising at least one dielectric resonator and an enclosure enclosing the dielectric resonator to function as a shield against an electromagnetic field according to the present invention comprises the steps of: (a) disposing, in a space enclosed by the enclosure, resonance-frequency tuning means including a conductor plate having a first surface opposed to a surface of the dielectric resonator and a second surface opposed to an inner surface of the enclosure to tune a resonance frequency by changing a distance between the conductor plate and the dielectric resonator; and (b) after or prior to the step (a), disposing a spurious-mode suppressing member for suppressing propagation of a spurious electromagnetic field mode produced in a space between the second surface of the conductor plate and the inner surface of the enclosure.

The arrangement suppresses the propagation of the spurious electromagnetic field mode produced between the second surface of the conductor plate of the resonance-frequency tuning member and the inner surface of the enclosure and allows easy tuning which prevents the occurrence of a disturbed characteristic due to the spurious electromagnetic field mode in the pass band (or stop band) of the frequency characteristic of the dielectric resonator filter.

The step (b) includes disposing the spurious-mode suppressing means to fill a part of the space between the second surface of the conductor plate and the inner surface of the enclosure. The arrangement suppresses the occurrence of a disturbed characteristic in the pass band (or stop band) by the effects of reducing the guide wavelength of the spurious mode excited in the space and shifting the spurious mode toward higher frequencies.

DETAILED DESCRIPTION OF THE INVENTION

Embodiment 1

Figure 1:
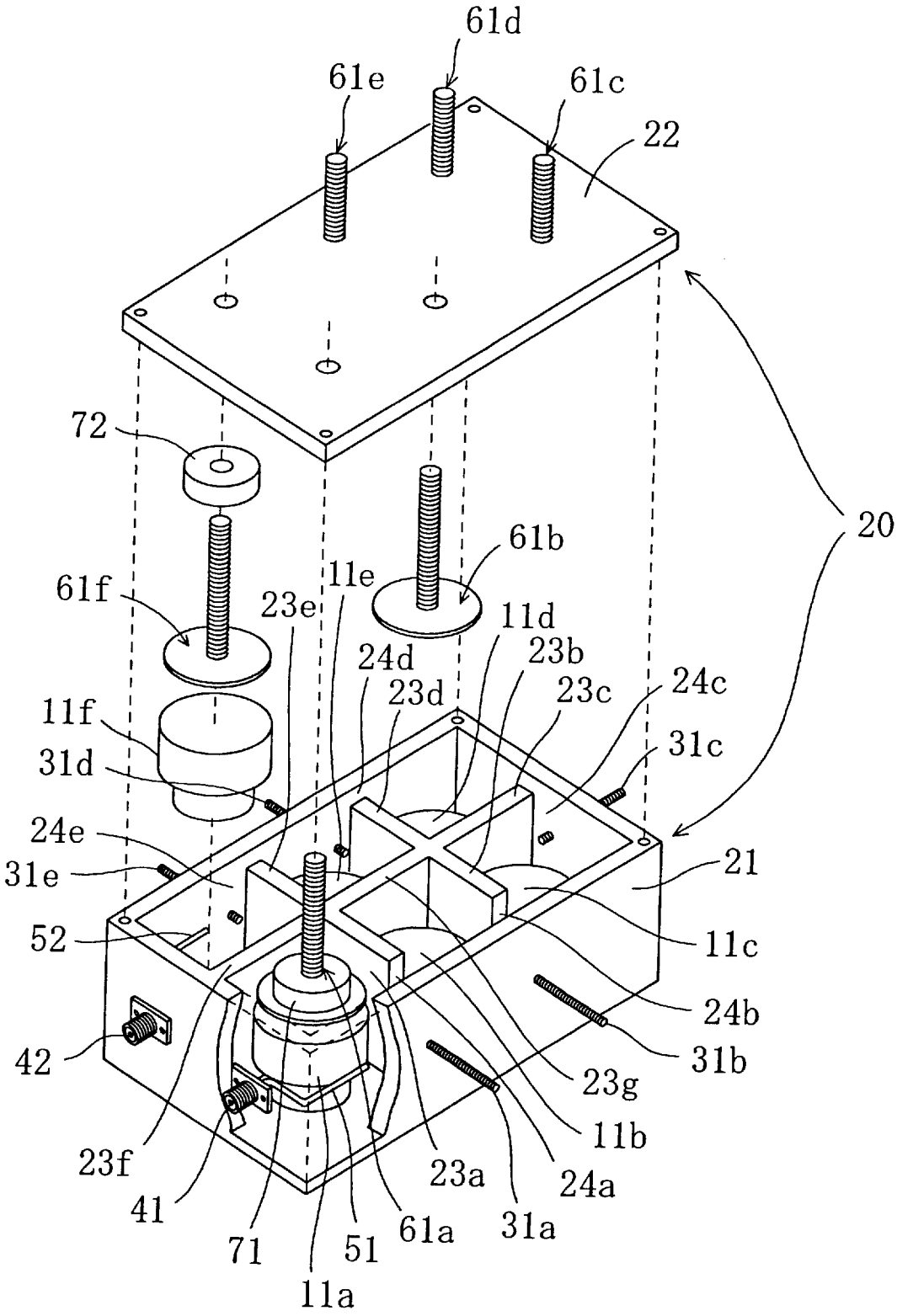
FIG. 1 is a perspective view schematically showing a structure of a dielectric resonator filter according to a first embodiment of the present invention.

FIG. 1 is a perspective view schematically showing a structure of a dielectric resonator filter according to a first embodiment of the present invention. As shown in FIG. 1, the dielectric resonator filter according to the present embodiment comprises six cylindrical dielectric resonators 11A to 11F formed by sintering a dielectric powder material. The resonance frequency of each of the dielectric resonators 11A to 11F is determined by the height and diameter of the cylindrical configuration thereof. In this example, the six dielectric resonators 11A to 11F operate as a six-stage band pass filter. An enclosure 20 of the dielectric resonator filter comprises a main body 21 composed of a bottom wall and side walls, a lid 22, partition walls 23A to 23G connected to each other to partition, into chambers, a space enclosed by the enclosure main body 21. The dielectric resonators 11A to 11F are disposed on a one-by-one basis in the respective chambers defined by the partition walls 23A to 23G of the enclosure 20. Interstage-coupling tuning windows 24A to 24E for providing electromagnetic field couplings between the resonators are provided between the five partition walls 23A to 23E of the seven partition walls 23A to 23G and the side walls of the enclosure main body 21. The interstage-coupling tuning windows 24A to 24E are provided with respective interstage-coupling tuning bolts 31A to 31E each for tuning the strength of an electromagnetic field coupling between the resonators. The enclosure main body 21 is provided with input/output terminals 41 and 42 each composed of a coaxial connector to input and output a high-frequency signal to and from the outside. An input coupling probe 51 and an output coupling probe 52 are connected to the respective core conductors of the input/output terminals 41 and 42.

Resonance-frequency tuning members 61A to 61F (resonance-frequency tuning means) each composed of a disk-shaped conductor plate and a bolt coupled integrally thereto to tune the resonance frequency of the corresponding one of the dielectric resonators 11A to 11F are attached to the enclosure lid 22. The resonance-frequency tuning members 61A to 61F are disposed to have their respective center axes at the same plan positions as the respective center axes of the dielectric resonators 11A to 11F (i.e., at the concentric positions). Specifically, the enclosure lid 22 is provided with screw holes which are at nearly concentric positions to the cylindrical dielectric resonators 11A to 11F such that the respective bolts of the resonance-frequency tuning members 61A to 61F are engaged with the screw holes of the enclosure lid 22. The resonance frequencies can be tuned by rotating the resonance-frequency tuning members 61A to 61F around the axes and thereby changing the distances between the conductor plates and the dielectric resonators 11A to 1F.

Since the frequency characteristics including passband width and attenuation characteristic of a dielectric resonator filter are generally determined by the resonance frequency and Q factor of each of the resonators and an amount of coupling between the individual dielectric resonators, the configuration and the like of each of the dielectric resonators are calculated from the specifications of the frequency characteristics of the filter at the design stage. In practice, however, filter characteristics as designed cannot be obtained due to an error in the configurations of the dielectric resonators and enclosure and to a mounting error. To provide filter characteristics as designed, the resonance-frequency tuning members 61A to 61F are provided in the conventional dielectric resonator filter to render the respective resonance frequencies of the dielectric resonators 11A to 11F variable. In addition, the interstage-coupling tuning bolts 31A to 31E are also provided to render the strengths of interstage couplings variable. Through the tuning using the tuning mechanism, desired filter characteristics are provided.

The present embodiment is characterized in that spurious-mode suppressing rings 71 and 72 (spurious-mode suppressing means) which are composed of a conductor and have screw holes for engagement with the bolts of the input- and output-stage resonance-frequency tuning members 61A and 61F are attached to the bolts.

To illustrate the effects achieved by the provision of the spurious-mode suppressing rings 71 and 72, a description will be given first to the operation of the dielectric resonator filter according to the present embodiment.

If a high-frequency signal transmitted from, e.g., a signal source or an antenna (not shown in FIG. 1) and inputted into the enclosure 20 via the input/output terminal 41 has a frequency within the pass band of the filter, the signal couples to an electromagnetic field mode in the input-stage dielectric resonator 11A by the effect of the input coupling probe 51 so that TE01δ as a basic resonance mode is excited. The basic resonance mode couples to respective electromagnetic field modes in the subsequent dielectric resonators 11B, 11C, . . . in succession through the interstage-coupling tuning windows 24A, 24B, . . . so that the electromagnetic field mode excited in the dielectric resonator 11F couples to the output coupling probe 52 and the high-frequency signal is outputted from the input/output terminal 42. On the other hand, the high-frequency signal having a frequency outside the pass band of the filter should be reflected without coupling to the basic resonance mode in the dielectric resonator and sent back from the input terminal 41.

For the foregoing filter to operate precisely, each of the dielectric resonators 11A to 11F should have a precise resonance frequency and each of the interstage-coupling tuning windows 24A, 24B, . . . should provide an interstage coupling having a precise strength. However, filter characteristics as designed cannot be provided due to an error in the configurations of the dielectric resonators 11A to 11F and enclosure 20 and to a mounting error. To provide filter characteristics as designed, the resonance-frequency tuning members 61A to 61F are provided and the conductor plates are moved upwardly or downwardly by rotating the bolts of the resonance-frequency tuning member 61A to 61F. As a result, the distances between the conductor plates of the resonance-frequency tuning members 61A to 61F and the dielectric resonators 11A to 11F located therebelow change to change the resonance frequencies of the dielectric resonators 11A to 11F. In addition, the interstage coupling bolts 31A to 31E are provided to render the strengths of interstage couplings variable. Through the tuning using the tuning mechanism, desired filter characteristics are provided.

If the amounts of insertion of the interstage-coupling tuning bolts 31A to 31E are increased to reduce the distances between the tip portions thereof and the side walls opposed thereto, e.g., the electromagnetic field coupling between the adjacent dielectric resonators (e.g., 11B and 11C) via the interstage-coupling tuning window (e.g., 24B) is intensified. If the resonance-frequency tuning members 61A to 61F are lowered in position to reduce the distances between the dielectric resonators and the conductor plates, the resonance frequencies of the dielectric resonators are increased. The functions described above are common to the conventional dielectric resonator filters.

However, the present embodiment features the spurious-mode suppressing rings 71 and 72 as spurious-mode suppressing means which are provided in a spurious-mode excitation space (the space R1 shown in FIG. 22) in the region between the resonance-frequency tuning members 61A and 61F and the enclosure lid 22. If the surfaces (lower surfaces) of the respective conductor plates of the resonance-frequency tuning members 61A and 61F opposed to the dielectric resonators 11A and 11F are assumed to be first surfaces and the surfaces (upper surfaces) of the conductor plates opposed to the inner surface of the enclosure lid 22 are assumed to be second surfaces, it follows that the spurious-mode suppressing rings 71 and 72 are disposed in the space R1 between the second surfaces of the conductor plates and the inner surface of the enclosure.

Figure 22:
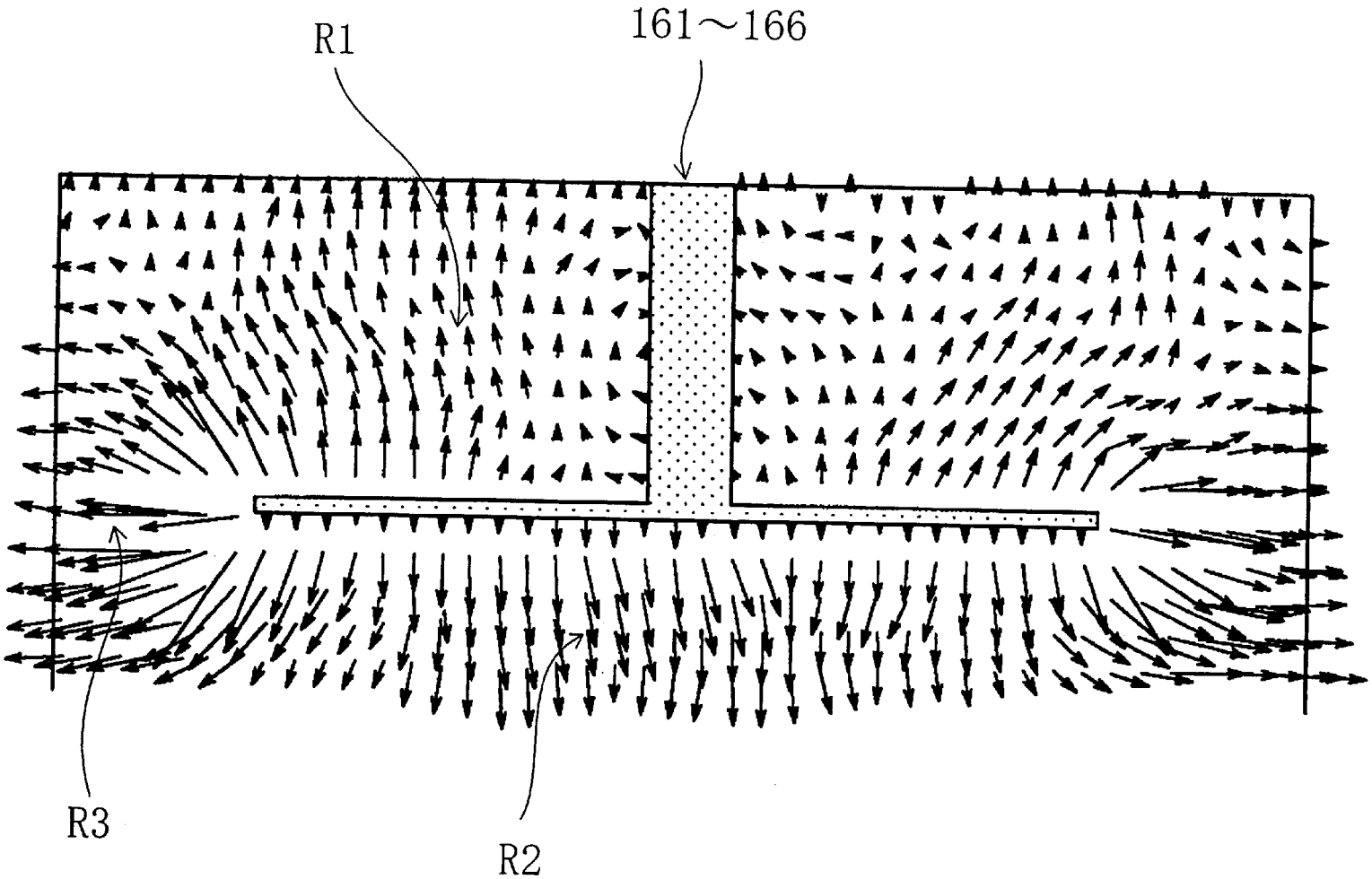
FIG. 22 PRIOR ART
FIG. 22 shows an electromagnetic field mode in the vicinity of the conductor plate of the resonance-frequency tuning member of the dielectric resonator filter shown in FIG. 21.
Figure 23:
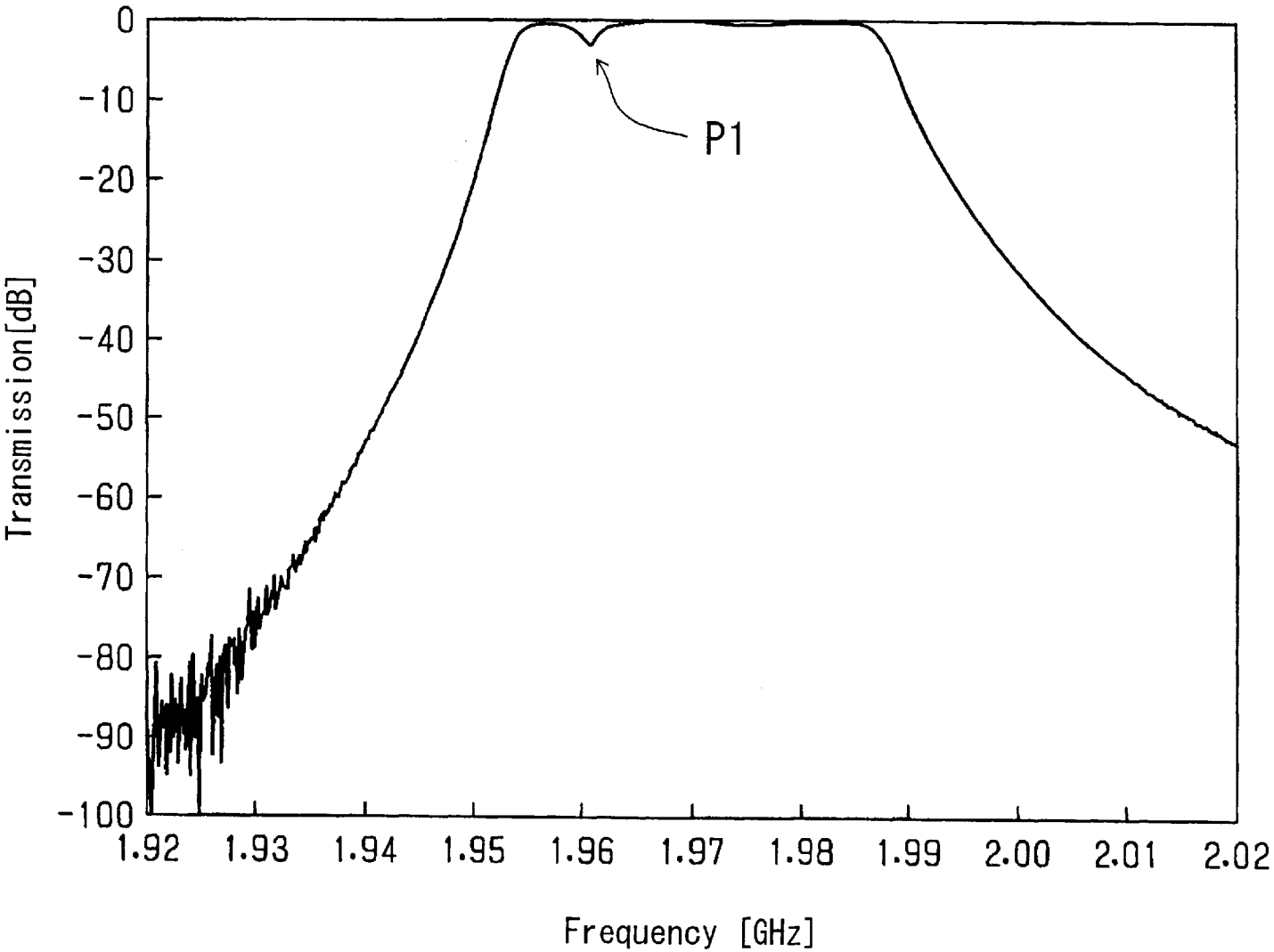
FIG. 23 PRIOR ART
FIG. 23 shows an example of the frequency characteristic of the dielectric resonator filter shown in FIG. 21.

The arrangement functions to suppress the production of the spurious mode shown in FIG. 22. From the viewpoint of electromagnetic fields, the provision of the spurious-mode suppressing rings 71 and 72 reduces the vertical size of the spurious-mode excitation space R1 and thereby reduces the guide wavelength of the excited spurious mode, so that the filter characteristic shifts toward higher frequencies. Moreover, the length of the narrow portion R3 (see FIG. 22) connecting from the spurious-mode excitation space R1 (see FIG. 22) to the space R2 (see FIG. 22) in which the dielectric resonators 11A and 11F are disposed is increased, which makes the passage of an electromagnetic wave through the narrow portion R3 difficult and weakens the coupling between the spurious mode and respective modes in the dielectric resonators 11A and 11F. As a result, the occurrence of a disturbed characteristic such as an undesired attenuation pole P1 (see FIG. 23) in the pass band of the dielectric resonator filter composed of the six dielectric resonators 11A to 11F can be suppressed.

Figure 2:
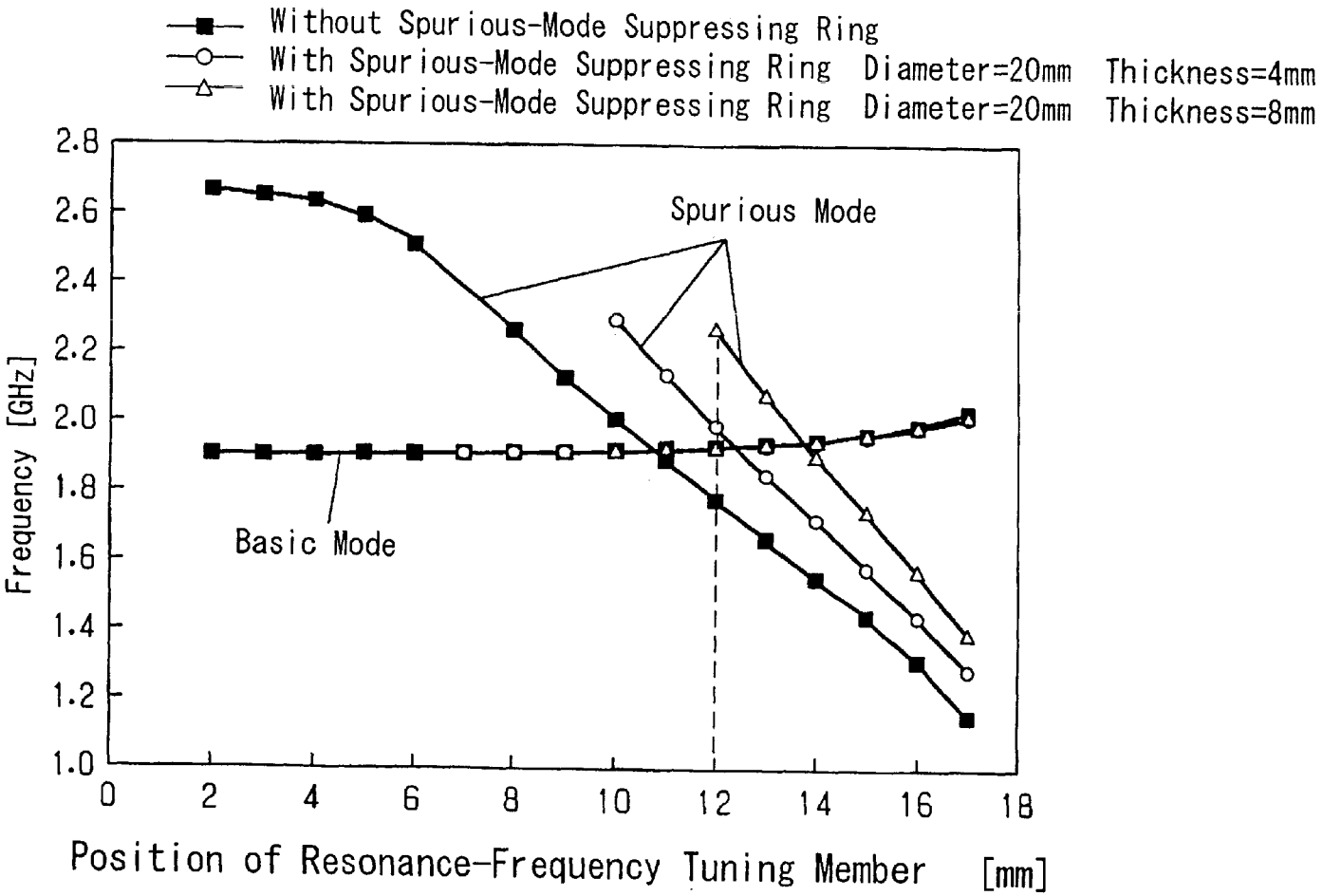
FIG. 2 is a graph showing the relationship between the position of a resonance-frequency tuning member in a single-stage filter and respective frequencies in a basic mode and a spurious mode.

FIG. 2 is a graph showing, when a single-stage filter (discrete resonator) is used, the relationship between the position of the resonance-frequency tuning member and respective frequencies in the basic mode and the spurious mode, which have been measured to examine the effect of the spurious-mode suppressing ring. The single-stage filter used to obtain the data shown in FIG. 2 comprises a cylindrical dielectric resonator composed of a dielectric material with a relative dielectric constant of 41 and having a diameter of 27 mm and a height of 12 mm, a cubic enclosure having inner sides of 40 mm, a resonance-frequency tuning member with a conductor plate having a diameter of 25 mm and a thickness of 1 mm and with a bolt compliant with the standard M6, and a cylindrical spurious-mode suppressing ring (spurious-mode suppressing means) composed of copper plated with silver, having a height of 4 mm or 8 mm and an outer diameter of 20 mm, and formed with a screw hole compliant with the standard M6 which is located in the center axis portion thereof.

As can be seen from FIG. 2, the provision of the spurious-mode suppressing ring shifts the spurious mode toward higher frequencies. If the position of the resonance-frequency tuning member is 12 mm in FIG. 2, the frequency in the spurious mode in the absence of the spurious-mode suppressing ring (indicated by the mark ■) is about 1.8 GHz. By contrast, the frequency in the spurious mode in the presence of a spurious-mode suppressing ring having an outer diameter of 20 mm and a height of 4 mm (indicated by the mark ○) is about 1.95 GHz and the frequency in the spurious mode in the presence of a spurious-mode suppressing ring having an outer diameter of 20 mm and a height of 8 mm (indicated by the mark Δ) is about 2.3 GHz.

Figure 3:
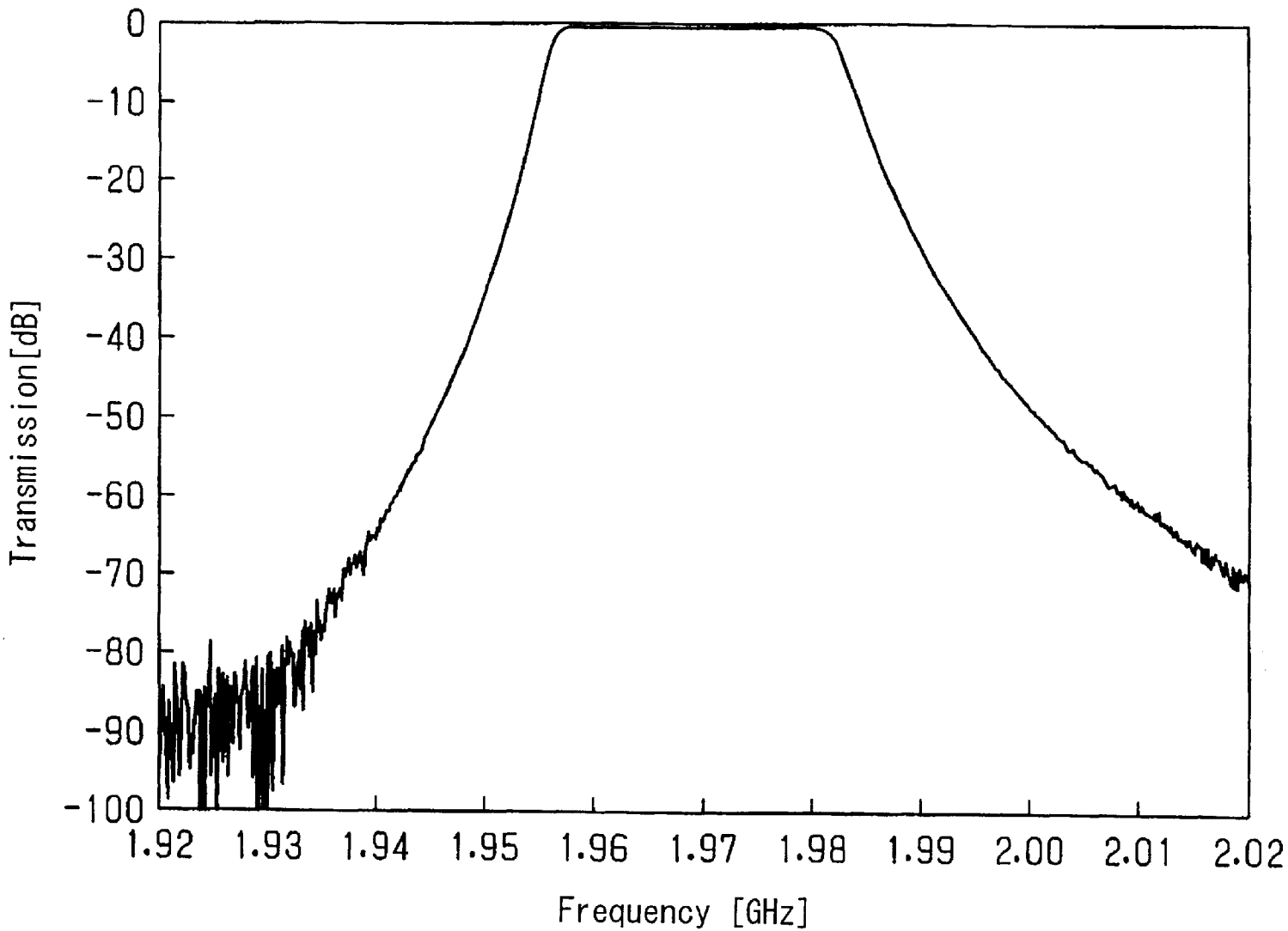
FIG. 3 shows the frequency characteristic of a dielectric resonator filter comprising a spurious-mode suppressing ring.

FIG. 3 shows the frequency characteristic of a dielectric resonator filter comprising a spurious-mode suppressing ring. In the drawing, the horizontal axis represents the frequency (GHz) and the vertical axis represents the transmission characteristic (dB). The dielectric resonator filter used to obtain the data shown in FIG. 3 comprises a cylindrical dielectric resonator composed of a dielectric material with a relative dielectric constant of 41 and having a diameter of 27 mm and a height of 12 mm, an aluminum enclosure having a silver-plated surface and cubic chambers each having inner sides of 40 mm, a resonance frequency tuning member with a conductor plate having a diameter of 25 mm and a bolt compliant with the standard M6, a cylindrical spurious-mode suppressing ring (spurious-mode suppressing means) composed of copper plated with silver, having a height of 8 mm and an outer diameter of 20 mm, and formed with a screw hole compliant with the standard M6 which is located in the center axis portion thereof, input/output terminals 41 and 42 each composed of a commercially available SMA connector, and input/output coupling probes 51 and 52 each composed of a copper wire having a silver-plated surface and a diameter of 1 mm.

As shown in FIG. 3, a TE01δ-mode electromagnetic field was excited in the dielectric resonator to provide a frequency characteristic which was nearly flat in the pass band. By thus providing the dielectric resonator filter with the spurious-mode suppressing ring, the amplitude level in the spurious mode was weakened and the spurious mode was shifted to higher frequencies at a sufficient distance from the pass band, so that the spurious mode presented no obstacle to the tuning of the frequency and the sharp filter characteristic with a low loss shown in FIG. 3 was achieved.

Although the present embodiment has disposed the only two spurious-mode suppressing rings 71 and 72 in the input and output stages, it is not limited to such a structure. The number of the spurious-mode suppressing means and the positions at which they are disposed can be determined selectively in accordance with the filter specifications.

It is to be noted that the spurious mode produced in the chambers in the input/output stages of a multi-stage filter is more likely to affect the filter characteristic since it is closer to the input/output coupling probes than the spurious mode produced in the other chambers. In fact, the cause of the degraded characteristic of the multi-stage filter is mostly the spurious mode produced in the chambers in the input/output stages. Therefore, the spurious-mode suppressing members such as the spurious-mode suppressing rings disposed in the chambers in the input/output stages achieve a remarkable spurious-mode suppressing function.

Although the present embodiment has fixed the spurious-mode suppressing rings 71 and 72 as the spurious-mode suppressing means to the resonance-frequency tuning members 61A and 61B, similar effects are also achievable if the spurious-mode suppressing means is fixed to the enclosure lid at the coaxial position to the resonance-frequency tuning member.

Although the present embodiment has adopted the structure in which the spurious-mode suppressing rings configured as independent ring structures are used as the spurious-mode suppressing means and fitted in the resonance-frequency tuning members, it is also possible to adopt the structure in which the spurious-mode suppressing means is formed integrally with the resonance-frequency tuning member by, e.g., attaching the stepped disk functioning as the spurious-mode suppressing means and also as the conductor plate of each of the resonance-frequency tuning members to the bolt of the resonance-frequency tuning member. Effects similar to those achieved by the present embodiment are achievable if the thickness of the conductor plate of each of the resonance-frequency tuning members is increased to about 3 to 10 mm. However, since the filter characteristic differs from one dielectric resonator filter to another in practice, a detachable members such as a ring is provided preferably.

Although the outer circumference of each of the spurious-mode suppressing rings 71 and 72 used as the spurious-mode suppressing means in the present embodiment is configured as a circle, the outer circumferential configuration of the spurious-mode suppressing ring is not limited thereto. Similar effects are also achievable if the outer circumference of the spurious-mode suppressing ring is configured as a triangle or another polygon. A description will be given herein below to variations of the structure of the spurious-mode suppressing ring.

Variation 1 of Embodiment 1

Figure 4:
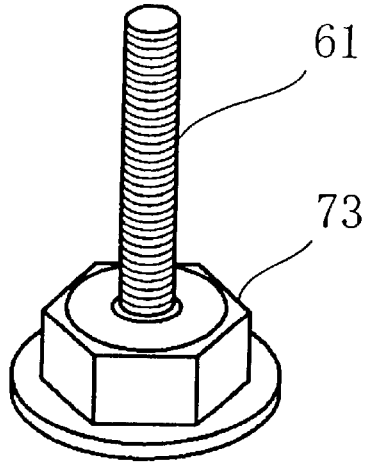
FIG. 4 is a perspective view showing respective structures of a resonance-frequency tuning member and a spurious-mode suppressing ring according to a first variation of the first embodiment.

FIG. 4 is a perspective view showing respective structures of a resonance-frequency tuning member and a spurious-mode suppressing ring according to a first variation of the first embodiment. As shown in FIG. 4, the spurious-mode suppressing ring 73 according to the first variation is configured as a hexagonal nut. The variation allows the use of a commercially available standard nut and reduces cost and the number of fabrication process steps.

Variation 2 of Embodiment 1

Figure 5:
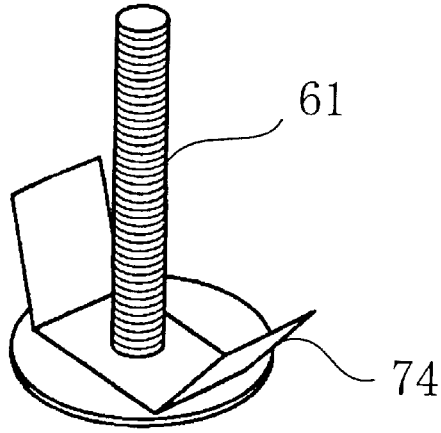
FIG. 5 is a perspective view showing respective structures of a resonance-frequency tuning member and a spurious-mode suppressing ring according to a second variation of the first embodiment.

FIG. 5 is a perspective view showing respective structures of a resonance-frequency tuning member and a spurious-mode suppressing ring according to a second variation of the first embodiment. As shown in FIG. 5, the spurious-mode suppressing ring 74 according to the second variation is configured as a plate spring formed by bending a conductor plate. The variation achieves the effect of substantially preventing the amount of lowering of the resonance-frequency spurious member 61 from affecting the function of suppressing the spurious mode of the spurious mode suppressing ring 74.

Variation 3 of Embodiment 1

Figure 6:
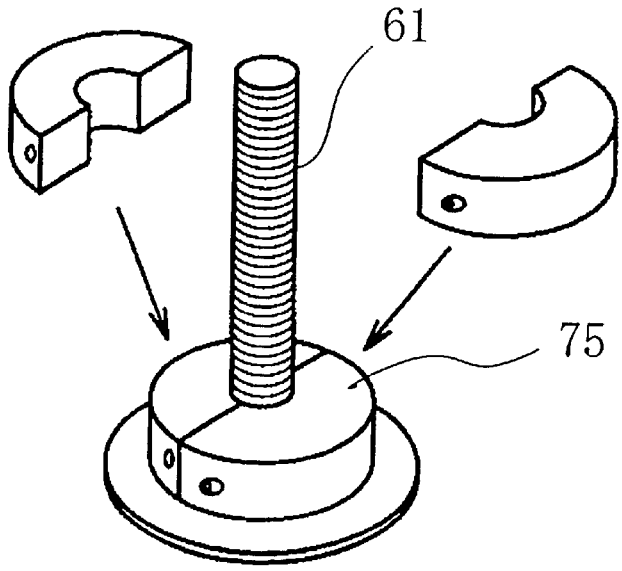
FIG. 6 is a perspective view showing respective structures of a resonance-frequency tuning member and a spurious-mode suppressing ring according to a third variation of the first embodiment.

FIG. 6 is a perspective view showing respective structures of a resonance-frequency tuning member and a spurious-mode suppressing ring according to a third variation of the first embodiment. As shown in FIG. 6, the spurious-mode suppressing ring 75 according to the third variation is configured as a divided ring. The present variation allows the spurious-mode suppressing rings 75 to be detached or attached without detaching the resonance-frequency tuning member 61 from the enclosure lid 22 and facilitates the operation of tuning the filter characteristic.

Although the present embodiment has used, as the spurious-mode suppressing means, the spurious-mode suppressing rings composed of copper and having the silver-plated surface, the material of the spurious-mode suppressing means according to the present invention is not limited thereto. It will be appreciated that another conductor material can also achieve the effects.

The material of the spurious-mode suppressing means is not limited to a conductor. Any material that could affect the propagation of an electromagnetic wave, such as a high-dielectric-constant dielectric material, can achieve similar effects.

Embodiment 2

Figure 7:
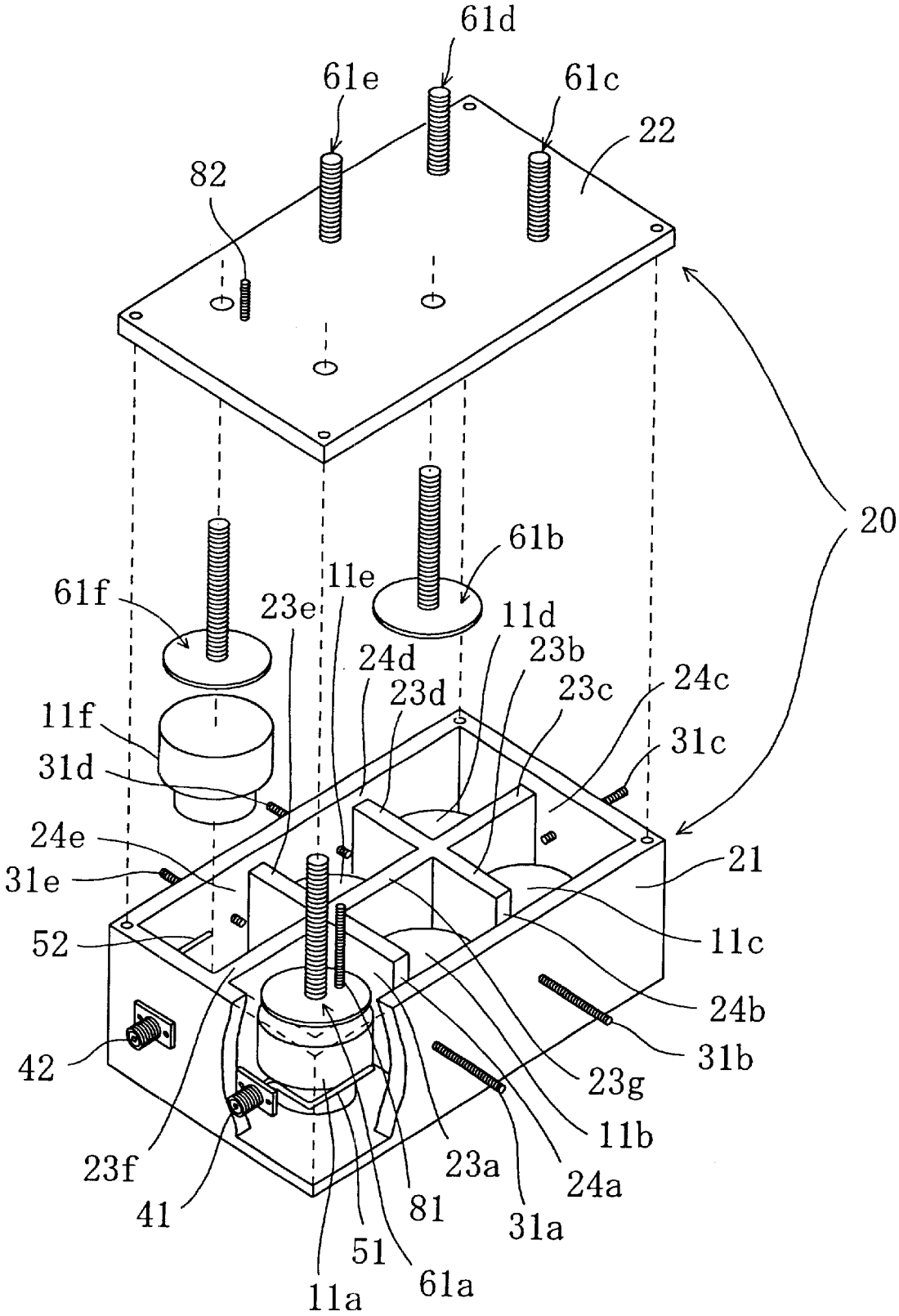
FIG. 7 is a perspective view schematically showing a structure of a dielectric resonator filter according to a second embodiment of the present invention.

FIG. 7 is a perspective view schematically showing a structure of a dielectric resonator filter according to a second embodiment of the present invention. As shown in FIG. 7, the dielectric resonator filter according to the present embodiment comprises, as the spurious-mode suppressing means, spurious-mode suppressing bolts 81 and 82 in place of the spurious-mode suppressing rings 71 and 72 according to the first embodiment. The spurious-mode suppressing bolts 81 and 82 are attached such that their respective proximal portions are engaged with the enclosure lid 22 and that their respective tip portions are in close proximity to the upper surfaces of the resonance-frequency tuning members 61A and 61F.

Since the structure of the dielectric resonator filter according to the present embodiment is the same as the structure of the dielectric resonator filter according to the first embodiment described already and shown in FIG. 1 except for the structures of the spurious-mode suppressing bolts 81 and 82, the description of the components shown in FIG. 7 which have the same function as in the first embodiment is omitted by retaining the same reference numerals as in FIG. 1.

The basic operation of the dielectric resonator filter according to the present embodiment is the same as that of the foregoing dielectric resonator filter according to the first embodiment.

In the dielectric resonator filter according to the second embodiment, a spurious electromagnetic field mode propagating in the spurious-mode excitation space R3 (see FIG. 22) is suppressed by the insertion of the spurious-mode suppressing bolts 81 and 82 into the spurious-mode excitation space R3 and the frequency in the spurious electromagnetic field mode shifts to lower frequencies. As a result, the occurrence of the disturbed characteristic such as the spurious attenuation pole P1 (see FIG. 23) in the pass band can be suppressed.

Figure 8:
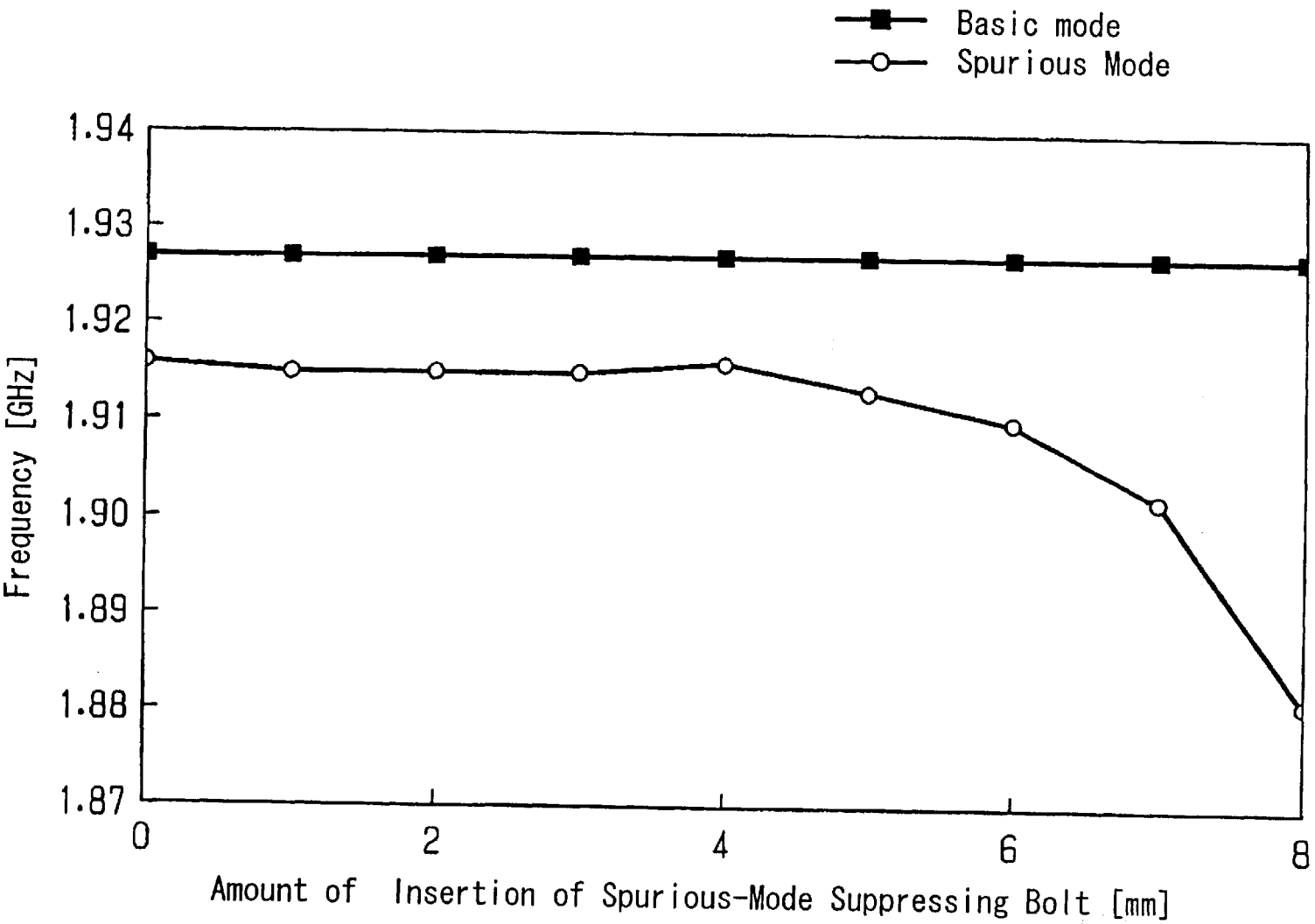
FIG. 8 is a graph showing the relationship between an amount of insertion of a spurious-mode suppressing bolt into a spurious-mode excitation space in a single-stage filter and respective frequencies in a basic mode and a spurious mode.

FIG. 8 is a graph showing, when a single-stage filter (discrete resonator) is used, the relationship between the amount of insertion of the spurious-mode suppressing bolt into the spurious-mode excitation space and respective frequencies in the basic mode and in the spurious mode, which have been measured to examine the effect of the spurious-mode suppressing bolt. The filter used to obtain the data shown in FIG. 8 comprises a cylindrical dielectric resonator composed of a dielectric material with a relative dielectric constant of 41 and having a diameter of 27 mm and a height of 12 mm, a cubic enclosure having inner sides of 40 mm, a resonance-frequency tuning member with a conductor plate having a diameter of 25 mm and a thickness of 1 mm and a bolt compliant with the standard M6, and a spurious-mode suppressing bolt (spurious-mode suppressing means) composed of copper plated with silver and having a screw compliant with the standard M3 at the outer circumferential portion thereof. In FIG. 8, the horizontal axis represents the amount of insertion of the spurious-mode suppressing bolt into the spurious-mode excitation space R3 when the state in which the spurious-mode suppressing bolt is in contact with the surface of the enclosure lid is assumed to be 0.

By thus providing the dielectric resonator filter with the spurious-mode suppressing bolt as the spurious-mode suppressing means, the spurious mode can be shifted to lower frequencies at a sufficient distance from the band pass and a filter with an excellent characteristic can be obtained.

Embodiment 3

Figure 9:
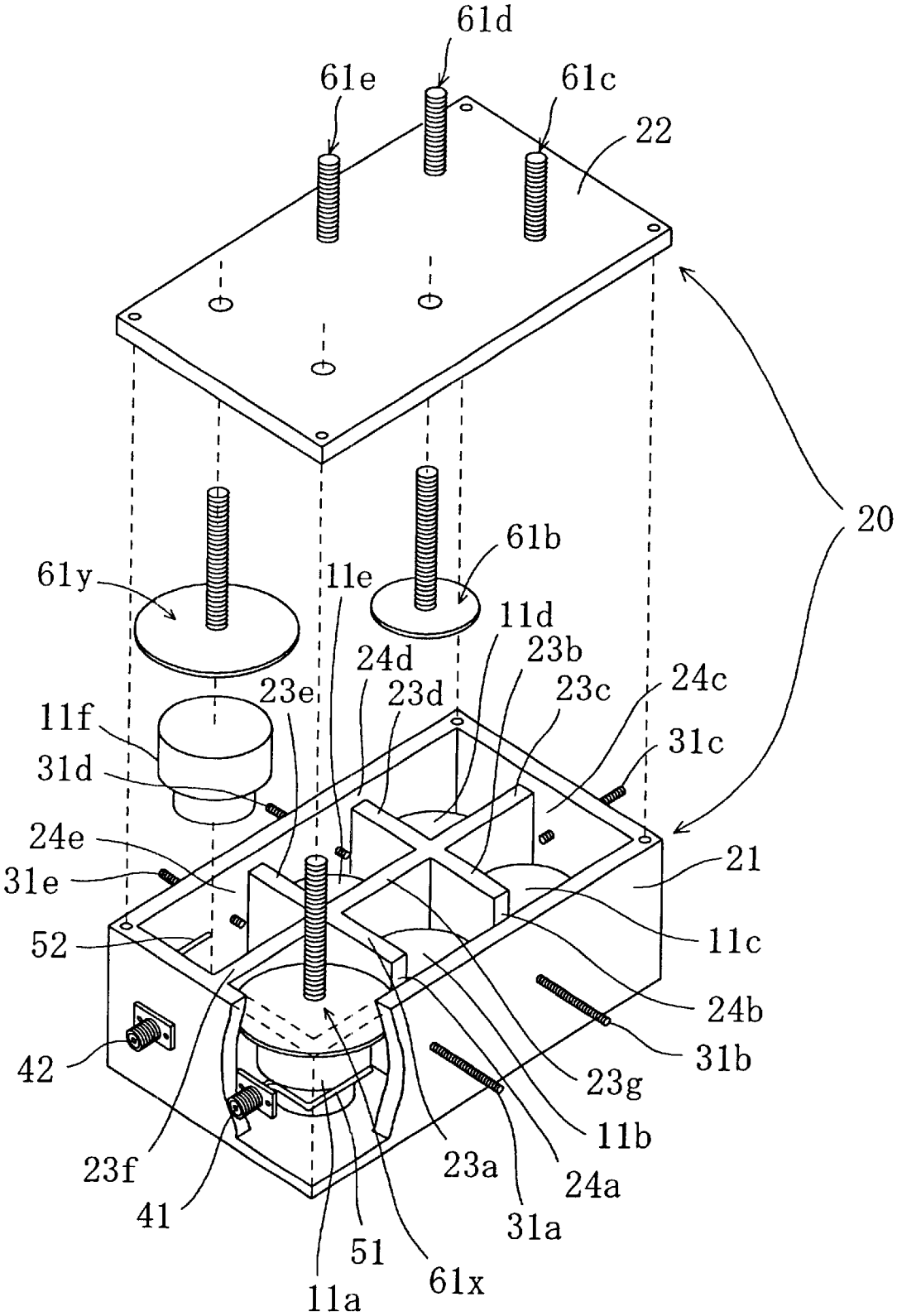
FIG. 9 is a perspective view schematically showing a structure of a dielectric resonator filter according to a third embodiment of the present invention.

FIG. 9 is a perspective view schematically showing a structure of a dielectric resonator filter according to a third embodiment of the present invention. As shown in the drawing, the dielectric resonator filter according to the present embodiment comprises, as the spurious-mode suppressing means, resonance-frequency tuning members 61X and 61Y with a spurious-mode suppressing function each having a larger-diameter conductor plate in place of the spurious-mode suppressing rings 71 and 72 according to the first embodiment.

Since the structure of the dielectric resonator filter according to the present embodiment is the same as the structure of the dielectric resonator filter according to the first embodiment described above and shown in FIG. 1 except for the structures of the resonance-frequency tuning members 61X and 61Y with the spurious-mode suppressing function, the description of the components shown in FIG. 9 which have the same function as in the first embodiment is omitted by retaining the same reference numerals as in FIG. 1.

The basic operation of the dielectric resonator filter according to the present embodiment is the same as that of the foregoing dielectric resonator filter according to the first embodiment.

In the dielectric resonator filter according to the third embodiment, each of the conductor plates of the resonance-frequency tuning members 61X and 61Y with the spurious-mode suppressing function has a larger diameter so that the guide wavelength of an electromagnetic wave in a direction parallel to the conductor plates is increased and the spurious mode shifts accordingly to lower frequencies. This suppresses the occurrence of the disturbed characteristic such as the undesired attenuation pole P1 (see FIG. 23) in the pass band.

Figure 10:
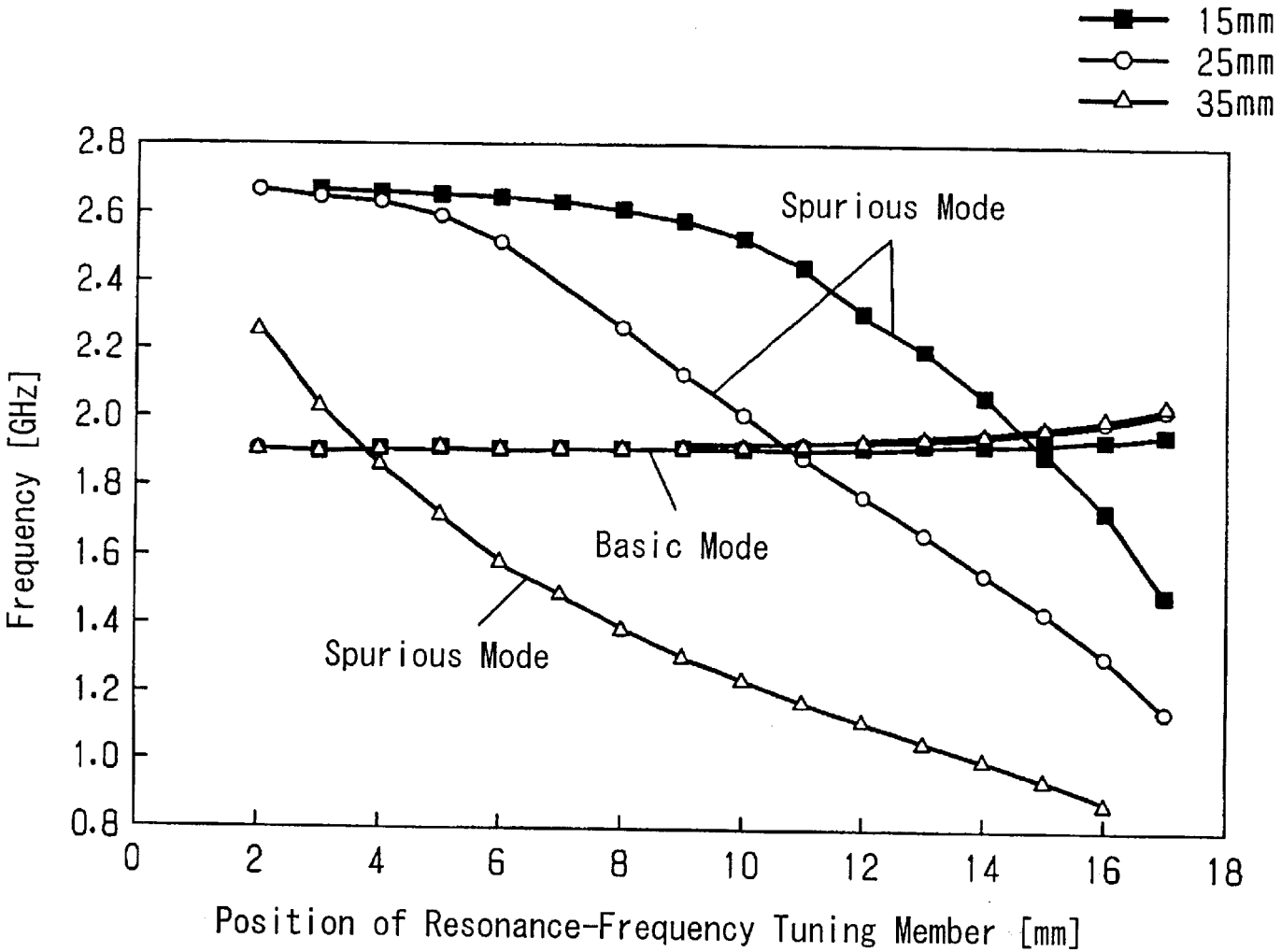
FIG. 10 is a graph showing the relationship between the position of a resonance-frequency tuning member and respective frequencies in a basic mode and a spurious mode, which have been measured to examine the effect of a resonance-frequency tuning member with a spurious-mode suppressing function.

FIG. 10 is a graph showing, when a single-stage filter (discrete resonator) is used, the relationship between the position of the resonance-frequency tuning member with the spurious-mode suppressing function and respective frequencies in the basic mode and in the spurious mode, which have been measured to examine the effect of the resonance-frequency tuning member with the spurious-mode suppressing function. The single-stage filter used to obtain the data shown in FIG. 10 comprises a cylindrical dielectric resonator composed of a dielectric material with a relative dielectric constant of 41 and having a diameter of 27 mm and a height of 12 mm, a cubic enclosure having inner sides of 40 mm, and a resonance-frequency tuning member with a conductor plate having a diameter of 15 mm, 25 mm, or 35 mm and with a bolt having a thickness of 1 mm and compliant with the standard M6.

As shown in FIG. 10, the frequency in the spurious mode differs depending on the diameter of the conductor plate. If the spurious mode enters the pass band to disturb the filter characteristic in a multi-stage dielectric resonator filter having a plurality of dielectric resonators disposed therein, the spurious mode can be expelled from the pass band by changing the diameter of the conductor plate of each of the resonance-frequency tuning members causing the spurious mode. If the effect is to be described in terms of electromagnetic fields, an increase in the diameter of the conductor plate of each of the resonance-frequency tuning members 61X and 61Y with the spurious-mode suppressing function increases the guide wavelength of an electromagnetic wave in a direction parallel to the conductor plates so that the spurious mode shifts toward lower frequencies.

Although the present embodiment has provided the first- and six-stage dielectric resonators 11A and 11F with the additional resonance-frequency tuning members 61X and 61Y with the spurious-mode suppressing function having conductor plates with diameters larger than those of the conductor plates of the other frequency tuning members, the structure of the dielectric resonator filter according to the present invention is not limited to the present embodiment. It is also possible to provide the other-stage dielectric resonators 11, such as the second- and third-stage dielectric resonators, with the additional resonance-frequency tuning members with the spurious-mode suppressing function. The stages of the dielectric resonators in which the resonance-frequency tuning members with larger-diameter conductor plates should be provided can be determined selectively and appropriately depending on the structures of the dielectric resonators, the enclosure, and the like.

Embodiment 4

Figure 11:
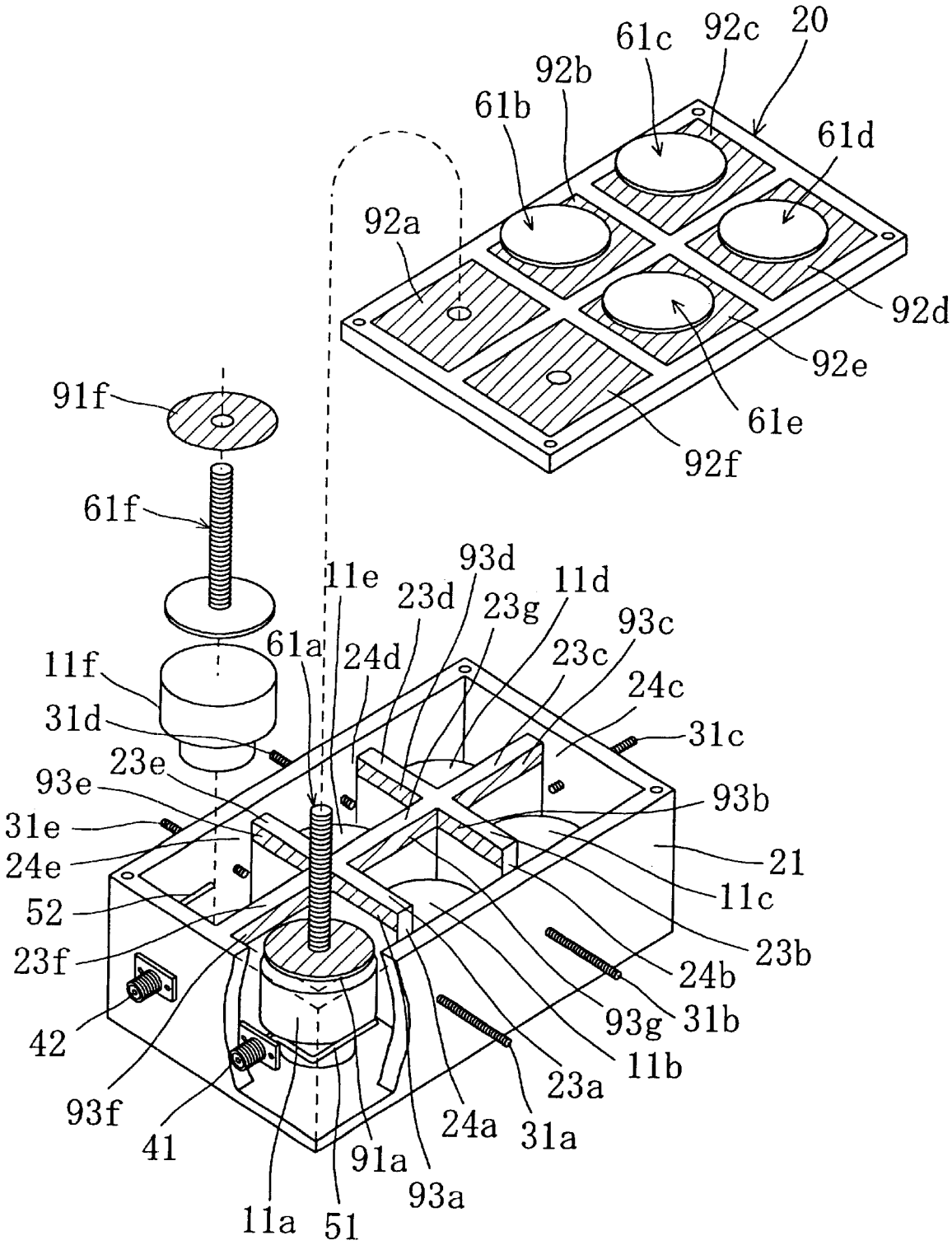
FIG. 11 is a perspective view schematically showing a structure of a dielectric resonator filter according to a fourth embodiment of the present invention.

FIG. 11 is a perspective view schematically showing a dielectric resonance filter according to a fourth embodiment of the present invention. As shown in FIG. 11, the dielectric resonator filter according to the present embodiment comprises, as the spurious-mode suppressing means, spurious-mode attenuating sheets 91A to 91F, 92A to 92F, and 93A to 93F in place of the spurious-mode suppressing rings 71 and 72 according to the first embodiment. The spurious-mode attenuating sheets 91A to 91F are provided on respective upper surfaces of the conductor plates (the surfaces of the conductor plates opposite to the resonators) of the resonance-frequency tuning members 61A to 61F. The spurious-mode attenuating sheets 92A to 92F are provided on the both side surfaces of the partition walls 23A to 23G of the enclosure 20. The spurious-mode attenuating sheets 93A to 93F are provided on the surface of the enclosure lid 22 corresponding to the respective ceiling surfaces of the chambers.

Since the structure of the dielectric resonator filter according to the present embodiment is the same as that of the dielectric resonator filter according to the first embodiment described already and shown in FIG. 1 except for the structures of the spurious-mode attenuating sheets 91A to 91F, 92A to 92F, and 93A to 93F, the description of the components shown in FIG. 11 which have the same function as in the first embodiment is omitted by retaining the same reference numerals as in FIG. 1.

The basic operation of the dielectric resonator filter according to the present embodiment is the same as that of the foregoing dielectric resonator filter according to the first embodiment.

In the dielectric resonator filter according to the present embodiment, the provision of the spurious-mode attenuating sheets 91A to 91F, 92A to 92F, and 93A to 93F attenuates currents flowing along the surfaces of the spurious-mode attenuating sheets 91A to 91F, 92A to 92F, and 93A to 93F with an electromagnetic wave generated in a spurious-mode excitation space (the space R1 shown in FIG. 22) in the region between the metal enclosure lid 22 and the resonance-frequency tuning members 61A to 61F, while the electromagnetic wave is also attenuated. Since the dielectric resonators 11A to 11F are isolated from the spurious-mode excitation space R1, the spurious-mode attenuating sheets 91A to 91F, 92A to 92F, and 93A to 93F have no influence on respective electromagnetic field modes in the dielectric resonators 11A to 11F and therefore have no influence on the characteristic of the dielectric resonator filter in the pass band. This suppresses the production of the spurious mode and provides a filter with an excellent characteristic. When nichrome (a nickel-chrome alloy) foils serving as resistor elements were used as the spurious-mode attenuating sheets, the spurious mode was attenuated and the same sharp filter characteristic with a low loss as shown in FIG. 3 was achieved.

Although the present embodiment has adopted the structure in which the spurious-mode attenuating sheets are disposed as the spurious-mode attenuating means, the structure of the spurious-mode attenuating means according to the present invention is not limited to a sheet structure. The spurious-mode attenuating means may be a conductor film obtained by applying and curing a paste or solvent containing a resistor element. Alternatively, the same effects as achieved by the present embodiment are achievable by composing, in principle, the partition walls of the enclosure, the enclosure lid, and the resonance-frequency tuning members with resistor elements each plated with a conductor and exposing the surfaces of the resistor elements in the space R1 without plating, with the conductor, the portions of the resistor elements serving as the inner wall surfaces defining the space R1 in the region between the enclosure lid and the conductors of the resonance-frequency tuning members.

Although the present embodiment has used the nichrome foils which are the resistor elements as the specific example of the spurious-mode attenuating sheets, the present invention is not limited thereto. It will be appreciated that the resistors composed of another material such as a copper-nickel alloy or ferrite also achieve the effects.

In the structure of each of the spurious-mode attenuating means, however, it is not necessary to compose the entire inner wall surfaces of the space R1 of members with a spurious-mode attenuating function since the vertical positions of the conductor plates of the resonance-frequency tuning members 61A to 61F change in response to the tuning of the resonance frequencies.

Although each of the first to fourth embodiments has described the multi-stage filter having the six dielectric resonators as an example of the dielectric resonance filter to which the present invention is applied, the structure of the dielectric resonator filter according to the present invention is not limited to the foregoing embodiments. The effects of the present invention are achievable if the dielectric resonator filter has stages other than four and six stages.

Although each of the first to fourth embodiments has described the band pass filter as an example of the dielectric resonator filter to which the present invention is applied, the structure of the dielectric resonator filter according to the present invention is not limited to the foregoing embodiments. The effects of the present invention are achievable with another type of filter such as a band stop filter.

Although each of FIGS. 2, 8, and 10 shows the result of measurement obtained by using the discrete resonator to define the effects by experiment, it will be appreciated that another multi-stage filter can also achieve the same effects irrespective of the number of stages by adopting the structure of each of the embodiments.

Although the first to fourth embodiments have disposed the dielectric resonators in a lower part of the space enclosed by the enclosure main body and disposed the conductor plates of the resonance-frequency tuning members above the dielectric resonators, it is also possible to dispose the dielectric resonators in the upper part of the space enclosed by the enclosure main body and dispose the conductor plates of the resonance-frequency tuning members below the dielectric resonators. In that case, the effects of the present invention can be achieved by disposing the spurious-mode suppressing members between the conductor plates of the resonance-frequency tuning members and the bottom surface of the enclosure main body.

Embodiment 5

Figure 12:
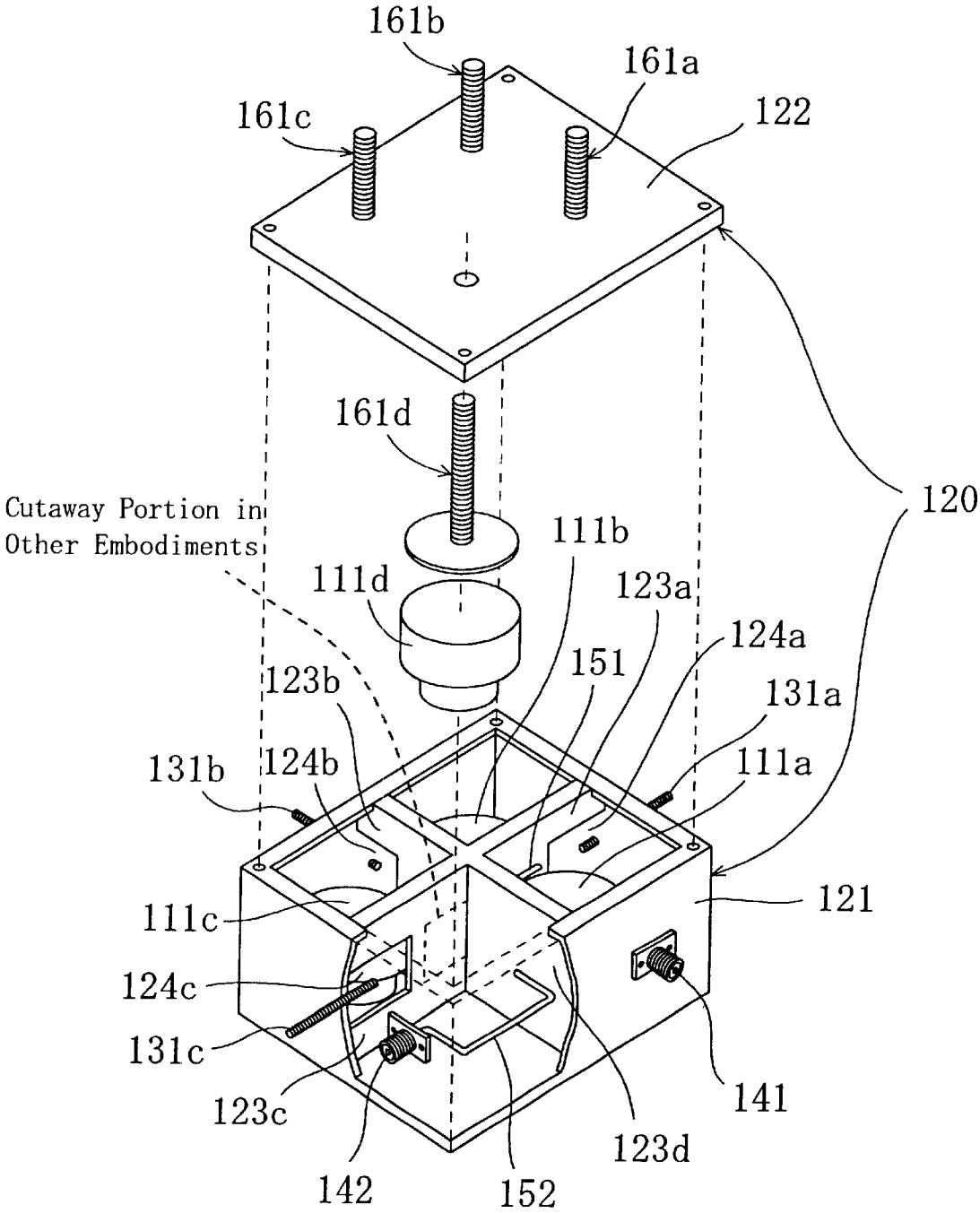
FIG. 12 is a perspective view schematically showing a structure of a dielectric resonator filter according to a fifth embodiment of the present invention.

FIG. 12 is a perspective view schematically showing a structure of a dielectric resonator filter according to a fifth embodiment of the present invention. As shown in FIG. 12, the dielectric resonator filter according to the present embodiment comprises four cylindrical dielectric resonators 111A to 111D formed by sintering a dielectric powder material. The resonance frequency of each of the dielectric resonators 111A to 111D is determined by the height and diameter of the cylindrical configuration thereof. In this example, the four dielectric resonators 111A to 111D operate as a four-stage band pass filter. An enclosure 120 of the dielectric resonator filter is composed of a main body 121, a lid 122, and partition walls 123A to 123D connected to each other to partition a space enclosed by the enclosure main body 121. The dielectric resonators 111A to 111D are disposed on a one-by-one basis in the respective chambers defined by the partition walls 123A to 123D of the enclosure 120. The enclosure main body 121 is provided with an input terminal 141 and an output terminal 142 each composed of a coaxial connector to input and output a high-frequency signal to and from the outside. An input coupling probe 151 and an output coupling probe 152 are connected to the respective core conductors of the input and output terminals 141 and 142.

Resonance-frequency tuning members 161A to 161D each composed of a disk-shaped conductor plate and a bolt coupled integrally thereto to tune the resonance frequency of the corresponding one of the dielectric resonators 111A to 111D are attached to the enclosure lid 122. The resonance-frequency tuning members 161A to 161D are disposed to have their respective center axes at the same plan positions as the respective center axes of the dielectric resonators 111A to 111D (i.e., at the concentric positions). Specifically, the enclosure lid 122 is provided with screw holes which are at nearly concentric positions to the cylindrical dielectric resonators 111A to 111D such that the respective bolts of the resonance-frequency tuning members 161A to 161D are engaged with the screw holes of the enclosure lid 122. The resonance frequencies can be tuned by rotating the resonance-frequency tuning members 161A to 161D around the axes and thereby changing the distances between the conductor plates and the dielectric resonators 111A to 111D.

Since the frequency characteristics including passband width and attenuation characteristic of a dielectric resonator filter are generally determined by the resonance frequency and Q factor of each of the resonators and an amount of coupling between the individual dielectric resonators, the configuration and the like of each of the dielectric resonators are calculated from the specifications of the frequency characteristics of the filter at the design stage. In practice, however, filter characteristics as designed cannot be obtained due to an error in the configurations of the dielectric resonators and enclosure and to a mounting error. To provide filter characteristics as designed, the resonance-frequency tuning members 161A to 161D are provided in the conventional dielectric resonator filter to render the respective resonance frequencies of the dielectric resonators 111A to 111D variable.

The present embodiment is characterized in that the three partition walls 123A to 123C of the four partition walls 123A to 123D are provided with interstage-coupling tuning windows 124A to 124C for providing electromagnetic couplings between the corresponding two of the dielectric resonators 111A to 111D. The interstage-coupling tuning windows 124A to 124C have been formed by providing the partition walls 123A to 123C with respective cutaway portions extending laterally from the portions (i.e., the outer side surfaces) of the partition walls 123A to 123C in contact with the inner side surfaces of the enclosure main body 121. In other words, the three partition walls 123A to 123C of the four partition walls 123A to 123D function as interstage-coupling tuning plates.

In the interstage-coupling tuning windows 124A to 124C composed of the cutaway portions in the partition walls 123A to 123C, there are disposed respective interstage-coupling tuning bolts 131A to 131C for finely tuning the strengths of electromagnetic field couplings between the resonators. The interstage-coupling tuning bolts 131A to 131C are disposed to protrude inwardly of the respective partition walls 123A to 123C.

A description will be given next to the operation of the dielectric resonator filter thus constituted. A high-frequency signal transmitted from, e.g., a signal source or an antenna (not shown in FIG. 12) is inputted into the enclosure 120 via the input terminal 141. If the high-frequency signal has a frequency within the pass band of the filter, it couples to an electromagnetic field mode in the input-stage dielectric resonator 111A by the effect of the input coupling probe 151 so that TE01δ as a basic resonance mode is excited. The resonance mode couples to respective electromagnetic field modes in the subsequent dielectric resonators 111B, 111C, . . . in succession through the interstage-coupling tuning windows 124A, 124B, . . . so that the electromagnetic field mode excited in the dielectric resonator 111F couples to the output probe 152 and the high-frequency signal is outputted from the output terminal 142. On the other hand, the high-frequency signal having a frequency outside the pass band of the filter is reflected without coupling to the resonance mode in the dielectric resonator and sent back from the input terminal 141.

For the foregoing filter to operate precisely, each of the dielectric resonators 111A to 111D should have a precise resonance frequency and each of the interstage-coupling tuning windows 124A to 124C should provide an interstage coupling with a precise strength. However, filter characteristics as designed cannot be provided due to an error in the configurations of the dielectric resonators 111A to 111D and enclosure 120 and to a mounting error. To provide filter characteristics as designed, the resonance-frequency tuning members 161A to 161D are provided and the conductor plate is moved upwardly or downwardly by rotating the bolts of the resonance-frequency tuning member 161A to 161D. As a result, the distances between the conductor plates of the resonance-frequency tuning members 161A to 161D and the dielectric resonators 111A to 111D located therebelow change to change the resonance frequencies of the dielectric resonators 111A to 111D.

On the other hand, the interstage-coupling tuning windows 124A to 124C provided in the partition walls 123A to 123C functioning as the interstage-coupling tuning plates and the interstage-coupling tuning bolts 131A to 131C are used to tune the strengths of electromagnetic field couplings between the dielectric resonators 111A to 111D. The strengths of interstage couplings are roughly determined by the areas of the interstage-coupling tuning windows 124A to 124C composed of the cutaway portions in the partition walls 123A to 123C. The strengths of the interstage couplings can be tuned finely by the amounts of insertion of the interstage-coupling tuning bolts 131A to 131C. Through the tuning using the tuning mechanism, the frequencies and width of the pass band of the dielectric resonator filter can be determined.

Figure 13:
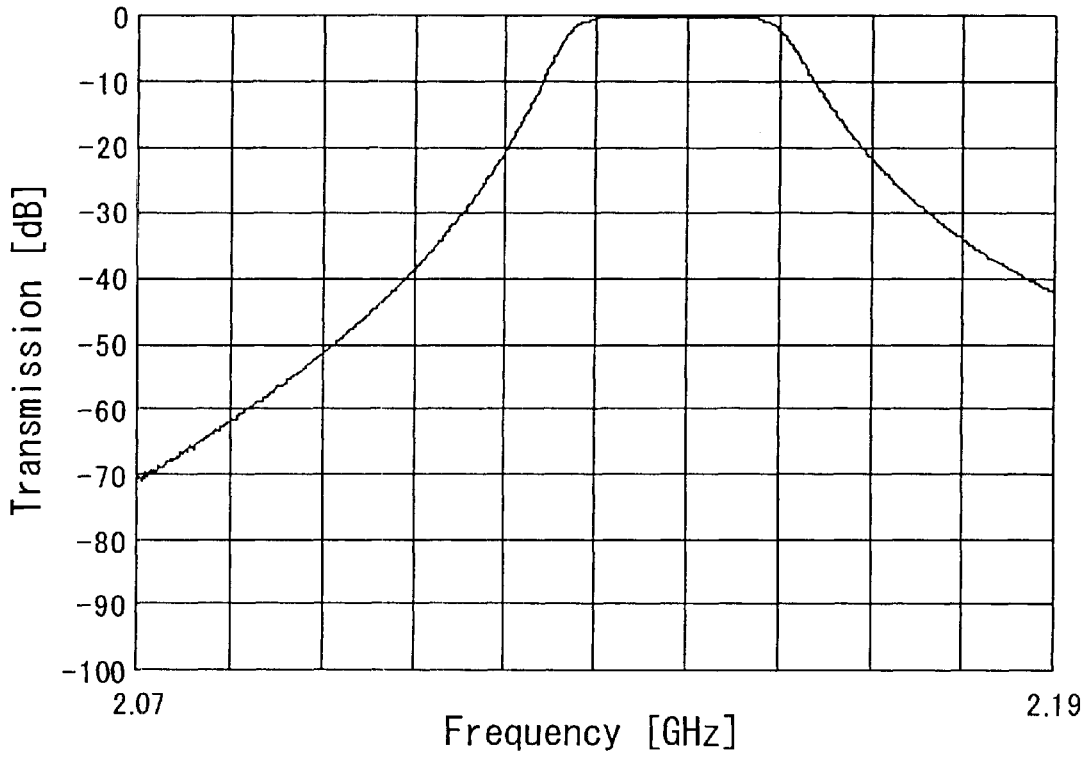
FIG. 13 shows the frequency characteristics of the dielectric resonator filter according to the fifth embodiment.

FIG. 13 shows the frequency characteristic of the dielectric resonator filter according to the present embodiment. If a high-frequency signal at a frequency outside of the pass band of the dielectric resonator is inputted, it is basically reflected and sent back from the input terminal 141 without exciting the basic resonance mode in the dielectric resonator. It follows therefore that the frequency characteristic of the dielectric resonator filter is basically a band pass characteristic as shown in FIG. 13. However, high-order modes such as the HE11δ mode and EH11δ mode are present in the dielectric resonators in addition to the TE01δ mode as the basic resonance mode. Since even electromagnetic field couplings in these resonance modes between the dielectric resonators permit a high-frequency signal to pass through the filter, there may be cases where an undesired harmonic peak appears at the higher frequencies of the pass band.

Figure 24:
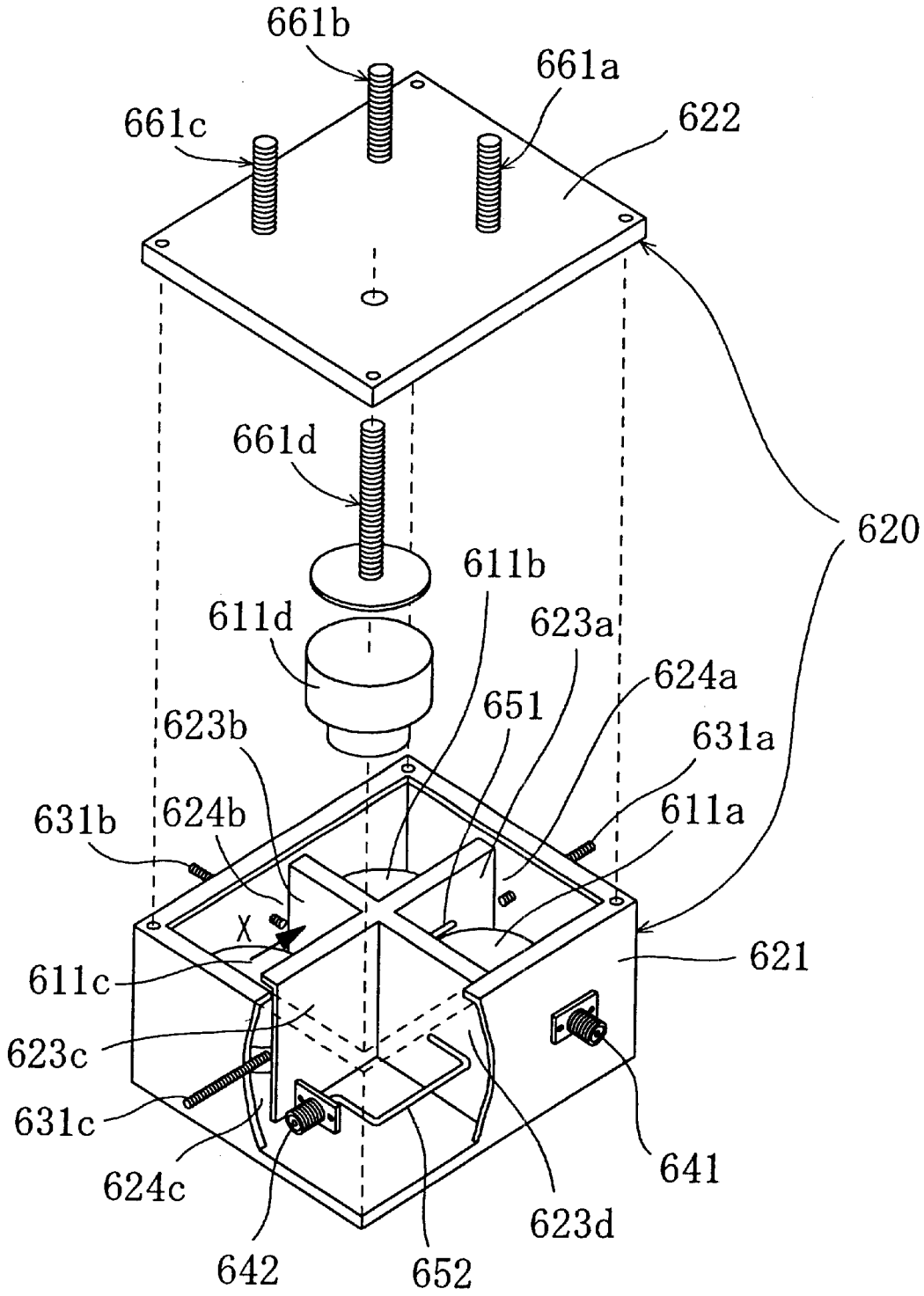
FIG. 24 PRIOR ART
FIG. 24 is a perspective view schematically showing an example of the conventional four-stage dielectric resonator filter.
Figure 26A:
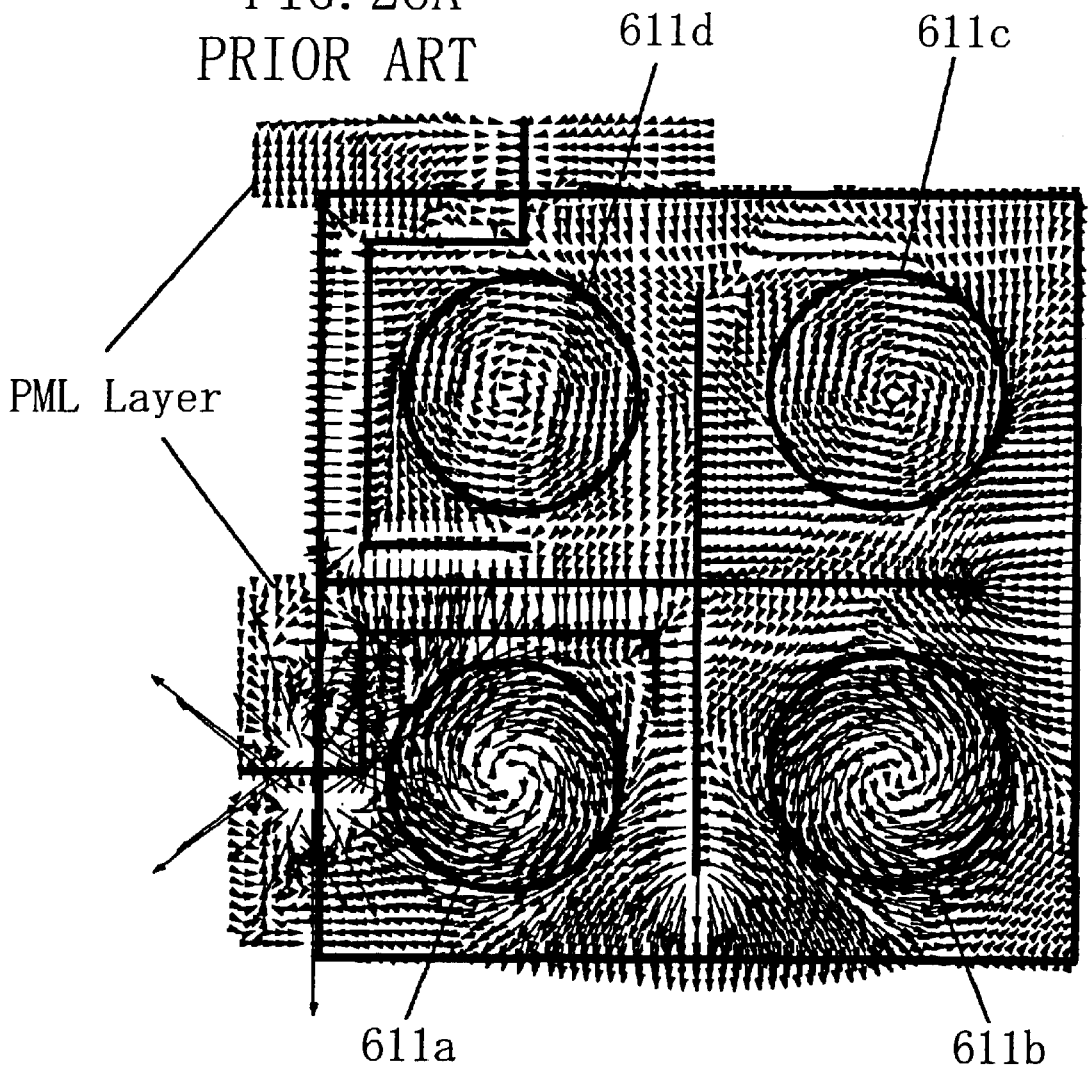
FIG. 26A PRIOR ART
FIG. 26 shows the result of analyzing the distribution of an electric field in accordance with the FDTD method when a high-frequency signal inputted to the conventional dielectric resonator filter shown in FIG. 24 is at 2.14 GHz (pass band)
Figure 26B:
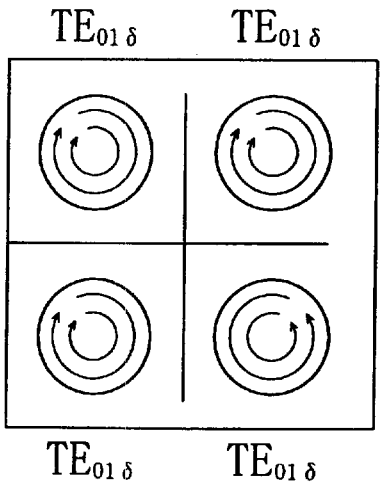
FIG. 26B PRIOR ART

FIG. 26 shows the result of analyzing the distribution of an electric field in accordance with the FDTD method when the high-frequency signal inputted to the conventional dielectric resonator filter shown in FIG. 24 is at 2.14 GHz (pass band). The distribution of the electric field shown in FIG. 26 is in a cross section parallel to the bottom surface of the enclosure and passing through the vertical center portion of the resonator (each of the results of analyses made subsequently is similarly in the cross section). The arrows in the drawing indicates electric field vectors at the positions. The dielectric resonator filter used to obtain the data shown in FIG. 26 comprises cylindrical dielectric resonators each composed of a dielectric material with a specific dielectric constant of 41 and having a diameter of 25 mm and a height of 11 mm and resonance-frequency tuning members each having an enclosure provided with four cubic chambers having inner sides of 40 mm. The dielectric resonators are disposed to have their lower surfaces located at 14.5 mm from the bottom surface of the enclosure main body.

As is obvious from the electric-field pattern shown in FIG. 26, the TE01δ mode as the basic mode is excited at frequencies of the pass band in the conventional dielectric resonator filter.

Figure 27A:
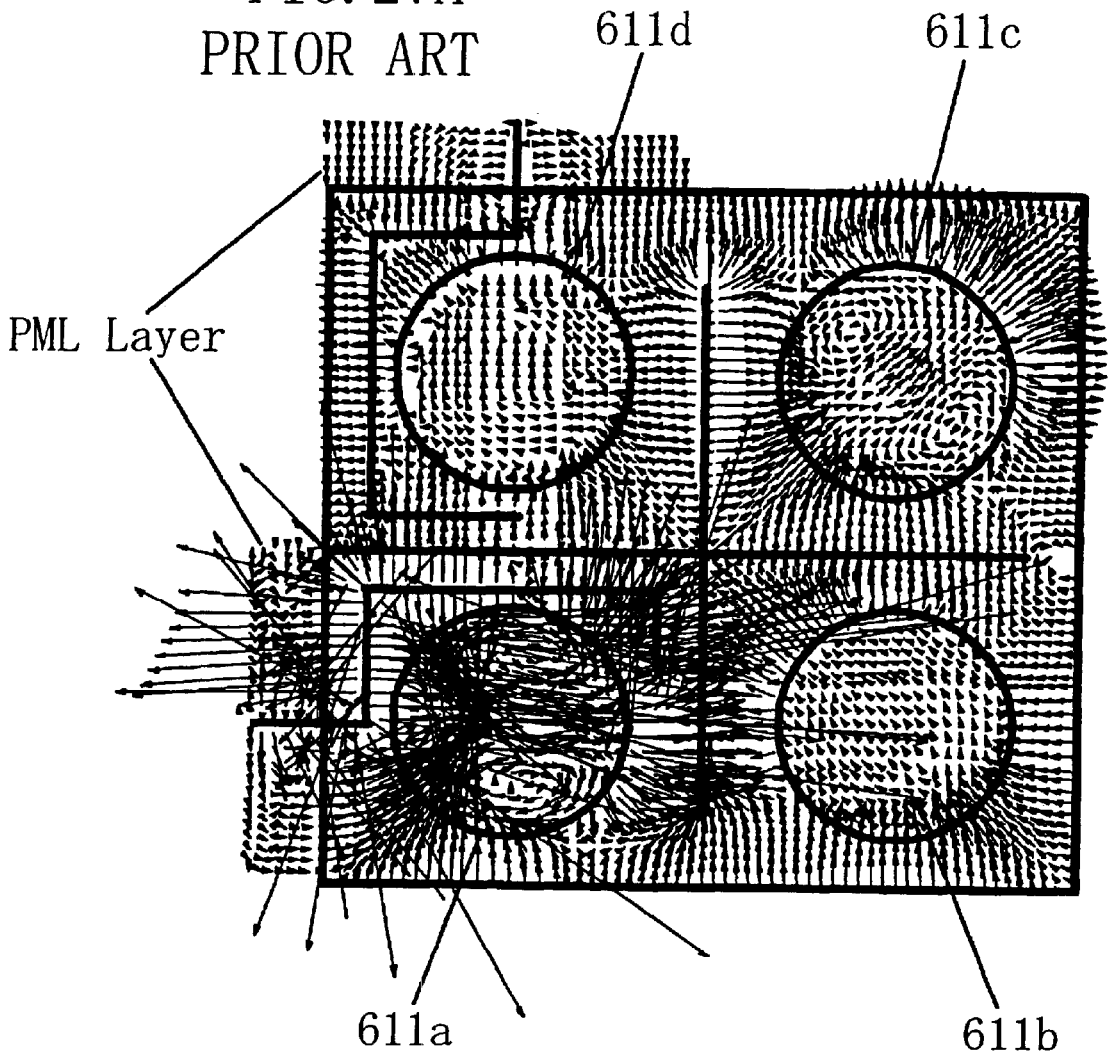
FIG. 27A PRIOR ART
FIG. 27 shows the result of analyzing the distribution of an electric field in accordance with the FDTD method when the high-frequency signal inputted to the dielectric resonator filter shown in FIG. 24 is at 2.82 GHz (harmonic)
Figure 27B:
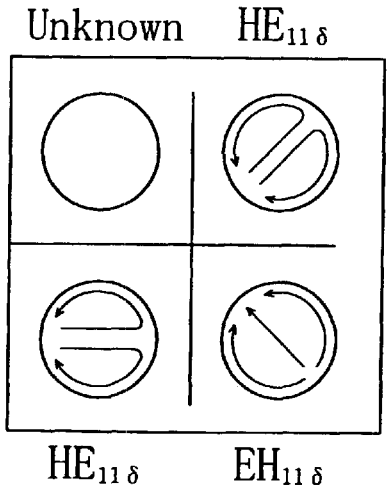
FIG. 27B PRIOR ART

FIG. 27 shows the result of analyzing the distribution of an electric field in accordance with the FDTD method when the high-frequency signal inputted to the conventional dielectric resonator filter shown in FIG. 24 is at 2.82 GHz (harmonic). In the electric field pattern shown in FIG. 27, high-order modes such as the HE11δ mode and EH11δ mode in the dielectric resonators are observed, which indicates that a harmonic has been caused in the dielectric resonator filter by the high-order modes in the dielectric resonators.

Figure 28:
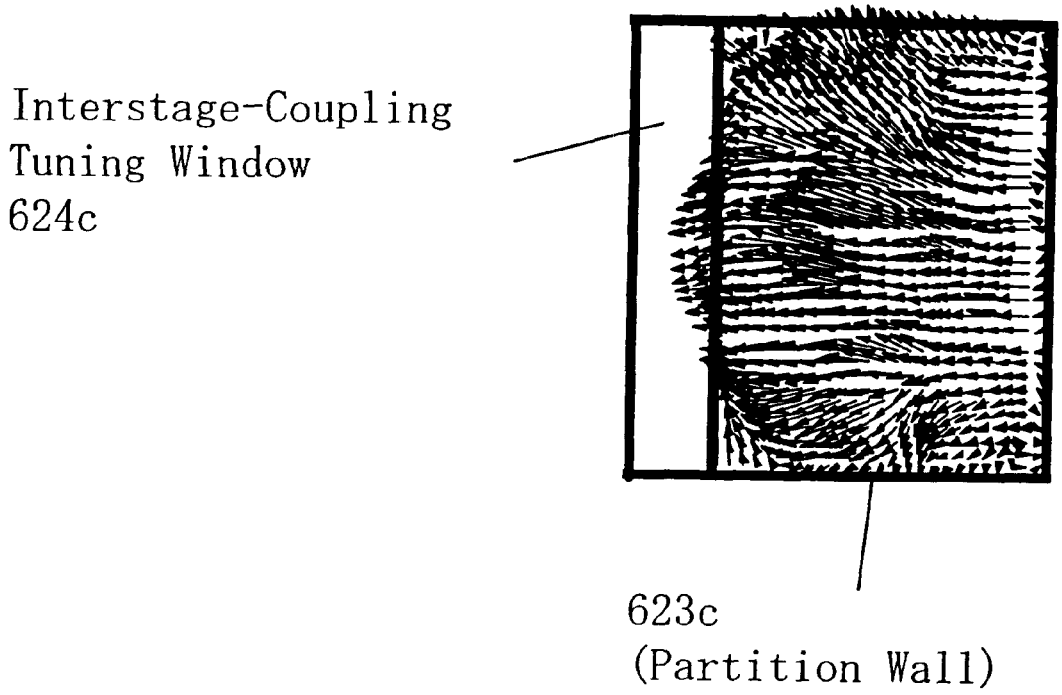
FIG. 28 PRIOR ART
FIG. 28 shows the result of analyzing, in accordance with the FDTD method, a current flowing along the surface of one of interstage-coupling tuning plates closer to the dielectric resonator in the HE11δ mode when the high-frequency signal inputted to the conventional dielectric resonator filter shown in FIG. 24 is at 2.82 GHz.

FIG. 28 shows the result of analyzing, in accordance with the FDTD method, a current flowing along the surface of the part of the partition wall (interstage-coupling tuning plate) 623B closer to the dielectric resonator 611C in the HE11δ mode when the high-frequency signal inputted to the conventional dielectric resonator filter shown in FIG. 24 is at 2.82 GHz (harmonic), which is viewed from the direction indicated by the arrow X shown in FIG. 24. As can be seen from FIG. 28, the current in the vicinity of the vertical center portion of the partition wall (interstage-coupling tuning plate) 623*c* in close proximity to the dielectric resonator is relatively large.

In the present embodiment, by contrast, the interstage-coupling tuning windows 124A to 124C are provided in the regions of the partition walls (interstage-coupling tuning plates) 123A to 123C in which relatively larger currents flow and no conductor is present in the regions so that the production of the HE11δ mode is presumably suppressed and the harmonic in the filter is presumably suppressed.

Figure 16A:
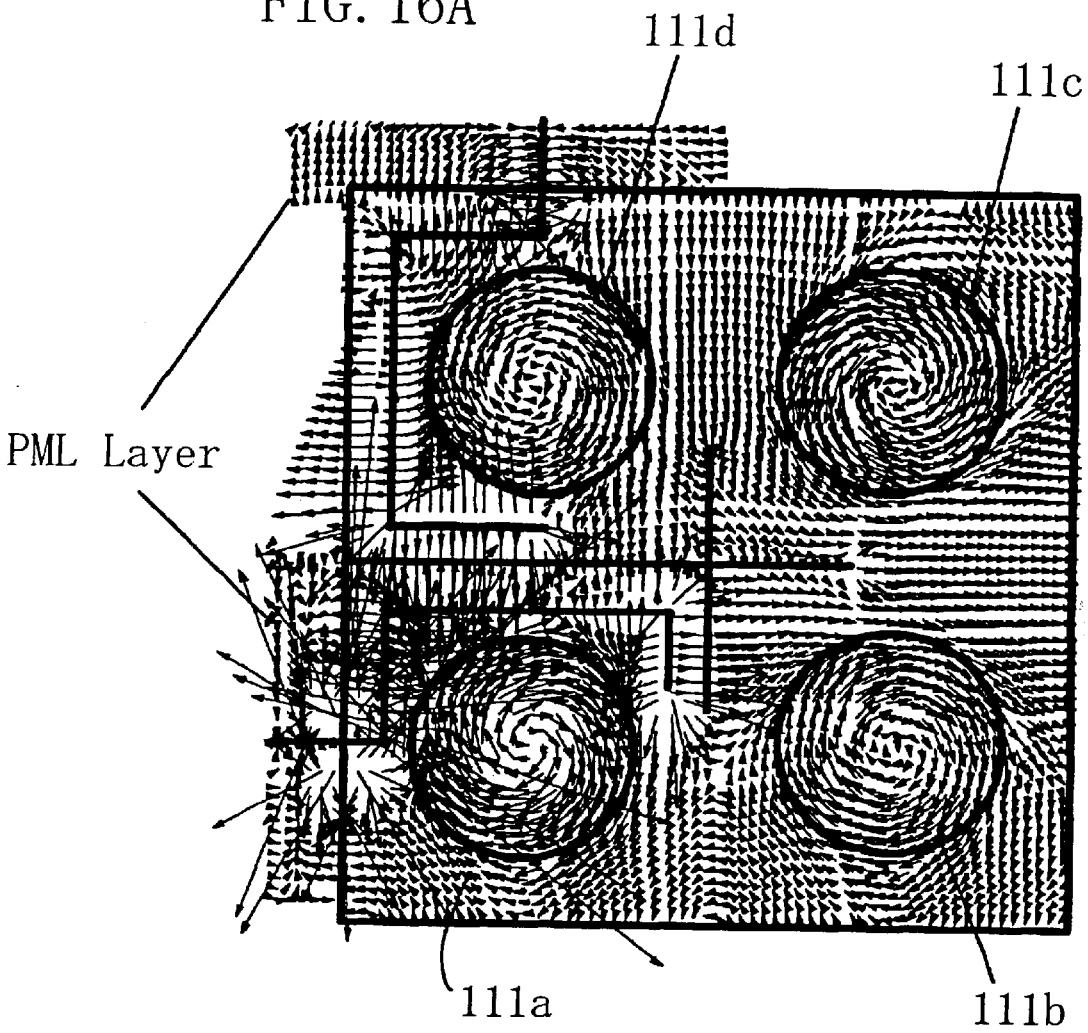
FIG. 16 shows the result of analyzing the distribution of an electric field when a high-frequency signal inputted to the dielectric resonator filter according to the fifth embodiment shown in FIG. 12 is at 2.14 GHz (pass band)
Figure 16B:
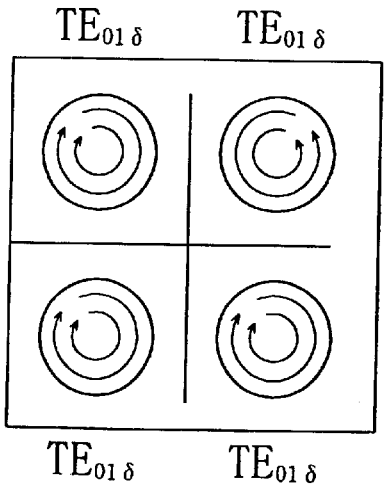

FIG. 16 shows the result of analyzing the distribution of an electric field when the high-frequency signal inputted to the dielectric resonator filter according to the present embodiment shown in FIG. 12 is at 2.14 GHz (pass band). For the dielectric resonator filter from which the data shown in FIG. 16 is obtained, calculation has been performed by assuming that each of the interstage-coupling tuning windows is configured as a rectangle which is 16 mm long and 25 mm wide and the lower edge of each of the interstage-coupling tuning windows is positioned at 12 mm from the bottom surface of the enclosure main body. As for the other factors, they are assumed to be the same as in the prior art analysis model mentioned above.

As shown in FIG. 16, the TE01δ mode as the basic mode is also excited in the present embodiment similarly to FIG. 26 so that the characteristic of the pass band of the dielectric resonator filter according to the present embodiment is assumed to be equal to that of the conventional embodiment.

Figure 17A:
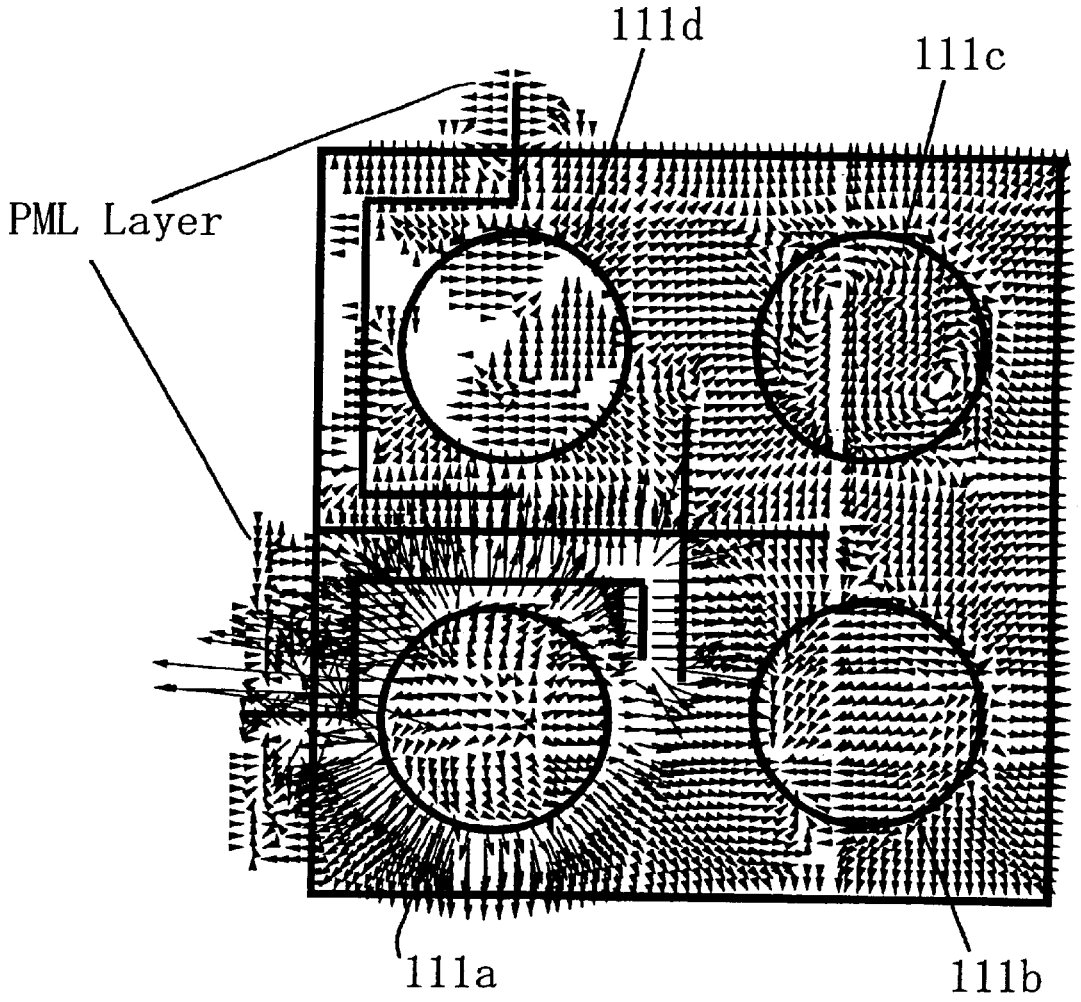
FIG. 17 shows the result of analyzing the distribution of an electric field when the high-frequency signal inputted to the dielectric resonator filter according to the fifth embodiment shown in FIG. 12 is at 2.82 GHz (harmonic)
Figure 17B:
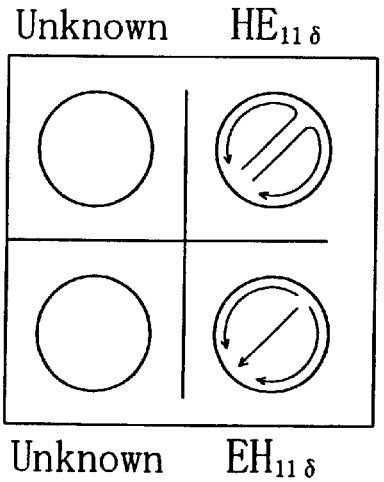

FIG. 17 shows the result of analyzing the distribution of an electric field when the high-frequency signal inputted to the dielectric resonator filter according to the present embodiment shown in FIG. 12 is at 2.82 GHz (harmonic). The dielectric resonator filter from which the data shown in FIG. 17 is obtained is the same as the dielectric resonator filter from which the data shown in FIG. 16 is obtained. As can be seen from the electric field pattern in the dielectric resonator 111A shown in FIG. 17, the HE11δ mode is indistinct so that it has been suppressed presumably.

Figure 14A:
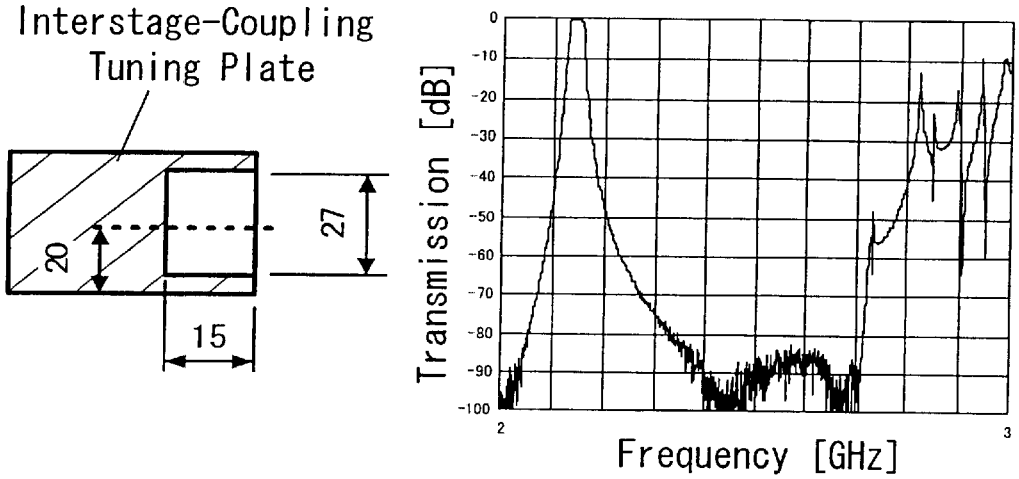
FIGS. 14A to 14C show the frequency characteristics of the dielectric resonator filter shown in FIG. 12 obtained by using interstage-coupling tuning windows having different configurations.
Figure 14B:
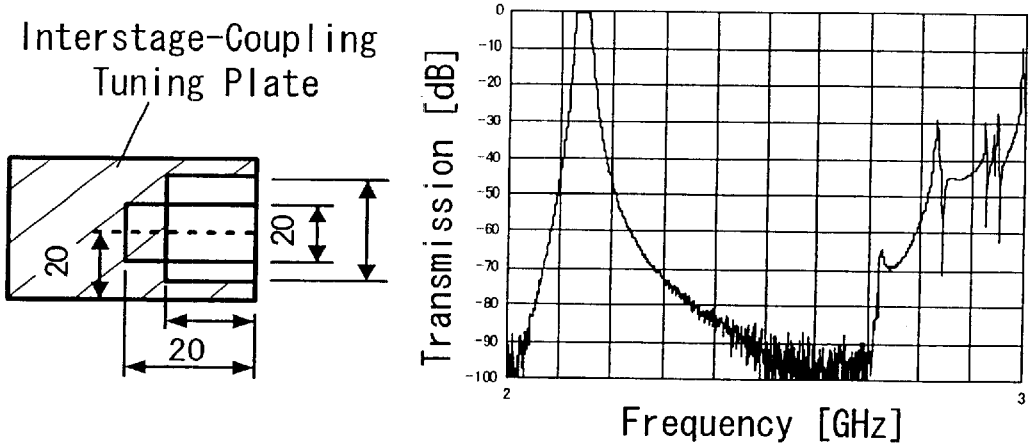
Figure 14C:
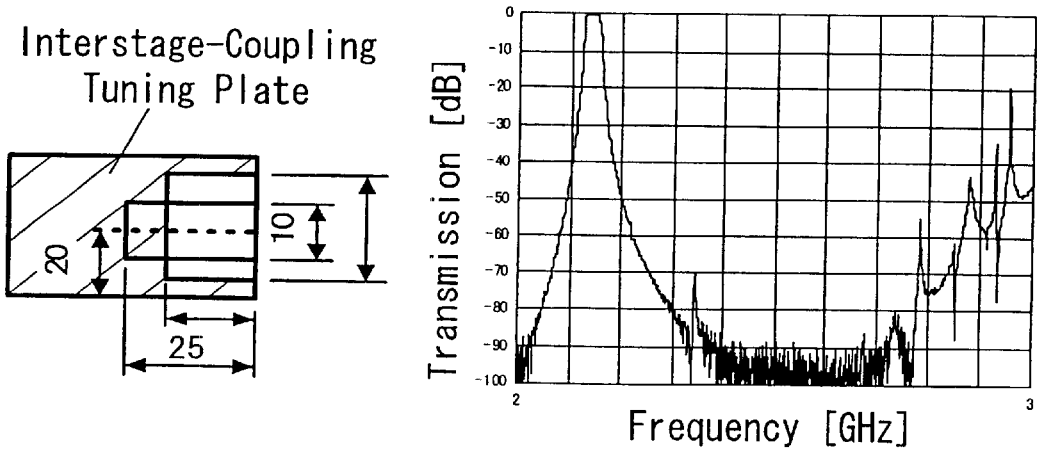

FIGS. 14A to 14C show the frequency characteristics of the dielectric resonator filter shown in FIG. 12 obtained by using the interstage-coupling tuning windows having different configurations. The dielectric resonator filter used to obtain the data shown in the drawings comprises cylindrical dielectric resonators each composed of a dielectric material with a relative dielectric constant of 41 and a having a diameter of 25 mm and a height of 11 mm, an aluminum enclosure having a silver-plated surface and four cubic chambers each having inner sides of 40 mm, resonance-frequency tuning members each composed of copper having a silver-plated surface and having a conductor plate with a diameter of 25 mm and a bolt compliant with the standard M6, input/output terminals each composed of a commercially available SMA connector, and input/output coupling probes each composed of a copper wire having a silver-plated surface and a diameter of 1 mm. It is assumed that the center axes extending in the lateral direction of the interstage-coupling tuning windows 124A to 124C composed of the cutaway portions in the partition walls 123A to 123C are fixed to a height of 20 mm from the bottom surface of the enclosure main body and the interstage-coupling tuning windows 123A to 123C providing interstage couplings with equal strengths are configured as three rectangles which are 27 mm long and 15 mm wide, 20 mm long and 20 mm wide, and 16 mm long and 25 mm wide.

Figure 25:
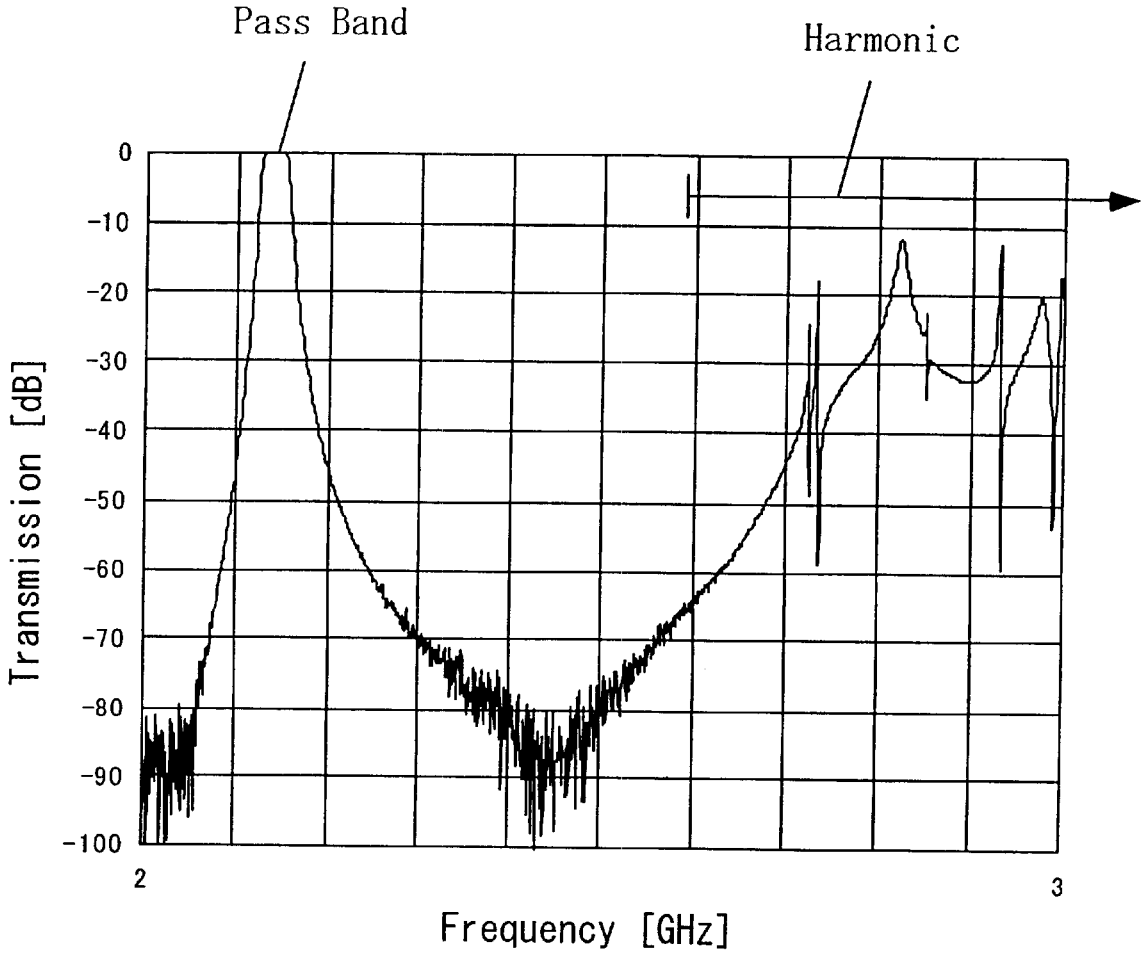
FIG. 25 PRIOR ART
FIG. 25 shows an example of the frequency characteristic of the conventional four-stage dielectric resonator filter.

In each of the characteristics shown in FIGS. 14A to 14C, the harmonic level in the harmonic band of 2.7 GHz to 3 GHz has been suppressed compared with the harmonic level in the conventional structure (see FIG. 25).

When FIGS. 14A to 14C were compared for the ratios between the lengths and widths of the rectangular configurations of the cutaway portions, the structure shown in FIG. 14C had the lowest harmonic level and it was proved that a higher effect of suppressing harmonic was achieved if the sides of the interstage-coupling tuning windows parallel to the bottom surface of the enclosure were longer.

Figure 15A:
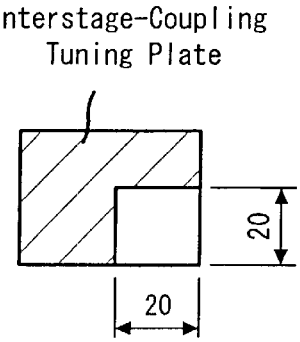
FIGS. 15A to 15C show the frequency characteristics of the dielectric resonator filter shown in FIG. 12 and the positions of the interstage-coupling tuning windows which are provided at different vertical positions in the partitions walls.
Figure 15A:
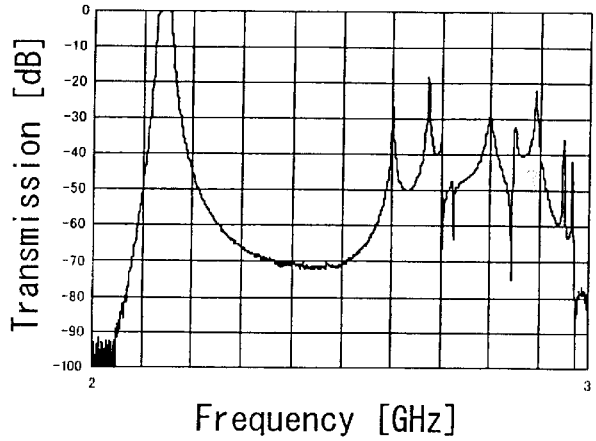
Figure 15B:
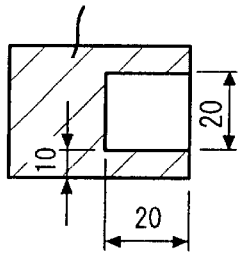
Figure 15B:
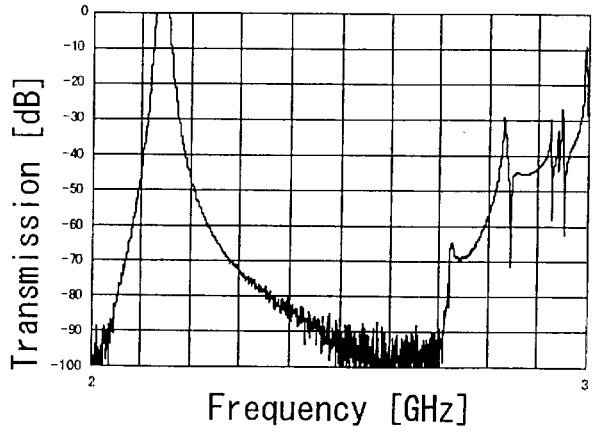
Figure 15C:
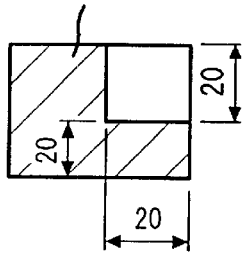
Figure 15C:
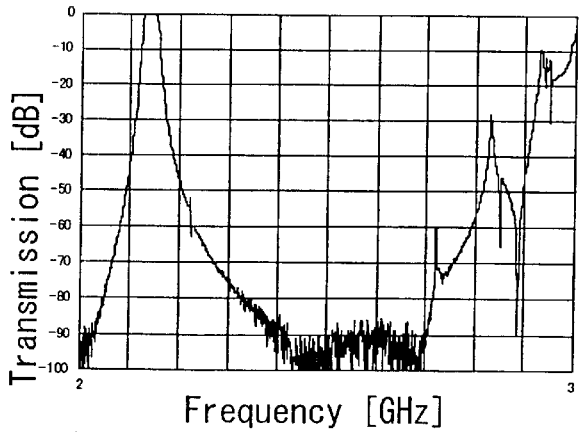

FIGS. 15A to 15C show the frequency characteristics of the dielectric resonator filter shown in FIG. 12 and the positions of the interstage-coupling tuning windows which are provided at different vertical positions in the partitions walls 123A to 123C. In the three cases shown in FIGS. 15A to 15C, the configuration of each of the interstage-coupling tuning windows 124A to 124C is limited to a square which is 20 mm long and 20 mm wide, while the lower sides of the windows are at different vertical positions of 0 mm, 10 mm, and 20 mm from the bottom surface of the enclosure main body. If FIGS., 15A to 15C are compared for the vertical positions of the interstage-coupling tuning windows 124A to 124C, the lowest harmonic level is obtained by providing the interstage-coupling tuning window at the position shown in FIG. 15B. This indicates that a higher effect of suppressing harmonic is achieved by positioning the interstage-coupling tuning window in the center portion such that the interstage-coupling tuning window and the dielectric resonator are in closer proximity.

By thus forming the interstage-coupling tuning windows 124A to 124C composed of the cutaway portions provided in the partition walls 123A to 123C functioning as the interstage-coupling tuning plates, the harmonic level can be suppressed in the dielectric resonator filter according to the present embodiment without affecting the characteristic of the pass band.

It was also found that a particularly high effect of suppressing the harmonic level was achieved when each of the interstage-coupling tuning windows 124A to 124C was configured to have a width larger than a length. If each of the interstage-coupling tuning windows 124A to 124C has a larger width, a wider movable range than in the conventional dielectric resonator filter is provided for each of the interstage-coupling tuning bolts 131A to 131C so that a wider range of tuning is provided for an interstage coupling. In that case, wide spacings are also provided between the tips of the interstage-coupling tuning bolts 131A to 131C and the vertical edges of the interstage-coupling tuning windows 124A to 124C so that resistance to high power is also increased.

In the conventional dielectric resonator filter shown in FIG. 24, the movable range of each of the interstage-coupling tuning bolts 631A to 631C is narrow and the range of tuning of an interstage coupling which is made by using the interstage-coupling tuning bolts 631A to 631C is narrow. If a high-frequency signal is inputted into the dielectric resonator filter, discharging may occur to damage the dielectric resonator filter depending on the state of tuning of the dielectric resonator filter since the spacing between the tip of the interstage-coupling tuning bolt 631A and the partition walls 623A to 623C is small. By contrast, the dielectric resonator filter according to the present embodiment can effectively suppress the occurrence of the undesired situations.

Embodiment 6

Figure 18:
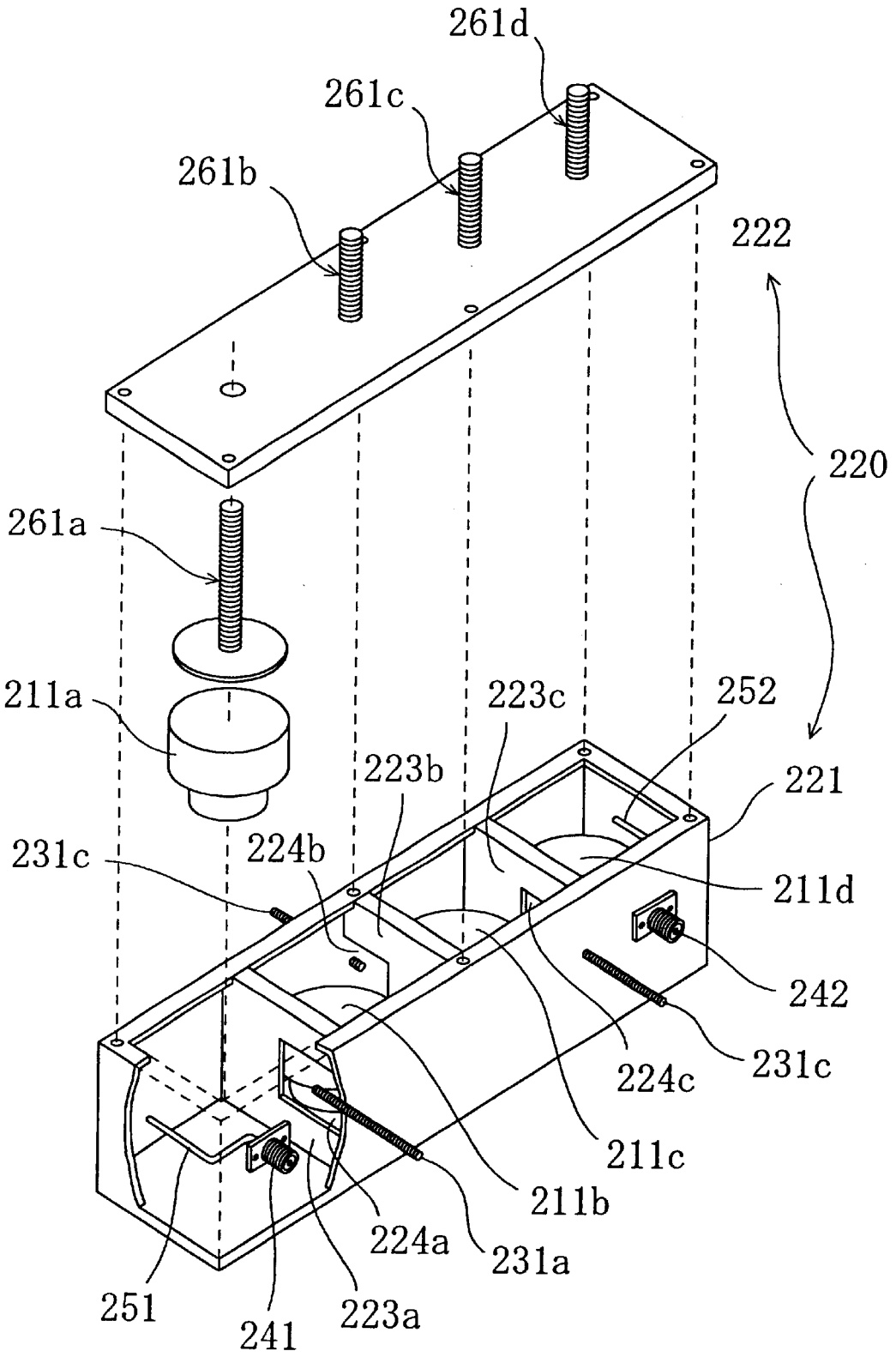
FIG. 18 is a perspective view schematically showing a structure of a dielectric resonator filter according to a sixth embodiment of the present invention.

FIG. 18 is a perspective view schematically showing a dielectric resonator filter according to a sixth embodiment of the present invention. As shown in FIG. 18, the dielectric resonator filter according to the present embodiment comprises four cylindrical dielectric resonators 211A to 211D formed by sintering a dielectric powder material. The resonance frequency of each of the dielectric resonators 211A to 211D is determined by the height and diameter of the cylindrical configuration thereof. In this example, the four dielectric resonators 211A to 211D operate as a four-stage band pass filter. An enclosure 220 of the dielectric resonator filter is composed of a main body 221, a lid 222, and partition walls 223A to 223C connected to each other to partition a space enclosed by the enclosure main body 221.

In the present embodiment, the enclosure main body 221 has a rectangular plan configuration and the dielectric resonators 211A to 211D are arranged linearly. Interstage-coupling tuning windows 224A to 224C composed of cutaway portions in the partition walls (interstage-coupling tuning plates) 223A to 223C are formed to alternate in position between the both side portions of the adjacent partition walls. The dielectric resonators 211A to 211D are disposed on a one-by-one basis in four chambers defined by the partition walls 223A to 223C of the enclosure 220. The enclosure main body 221 is provided with an input terminal 241 and an output terminal 242 each composed of a coaxial connector to input and output a high-frequency signal to and from the outside. An input coupling probe 251 and an output coupling probe 252 are connected to the respective core conductors of the input and output terminals 241 and 242.

Resonance-frequency tuning members 261A to 261D each composed of a disk-shaped conductor plate and a bolt coupled integrally thereto to tune the resonance frequency of the corresponding one of the dielectric resonators 211A to 211D are attached to the enclosure lid 222. The resonance-frequency tuning members 261A to 261D are disposed to have their respective center axes at the same plan positions as the respective center axes of the dielectric resonators 211A to 211D (i.e., at the concentric positions). The structure and function of each of the resonance-frequency tuning members 261A to 261D are the same as in the fifth embodiment.

The present embodiment also provides a dielectric resonator filter operating as a band pass filter with high resistance to electric power in which the level of an undesired harmonic appearing at the higher frequencies of the pass band is low and the range of tuning of an interstage coupling is wide, similarly to the fifth embodiment.

Embodiment 7

Figure 19:
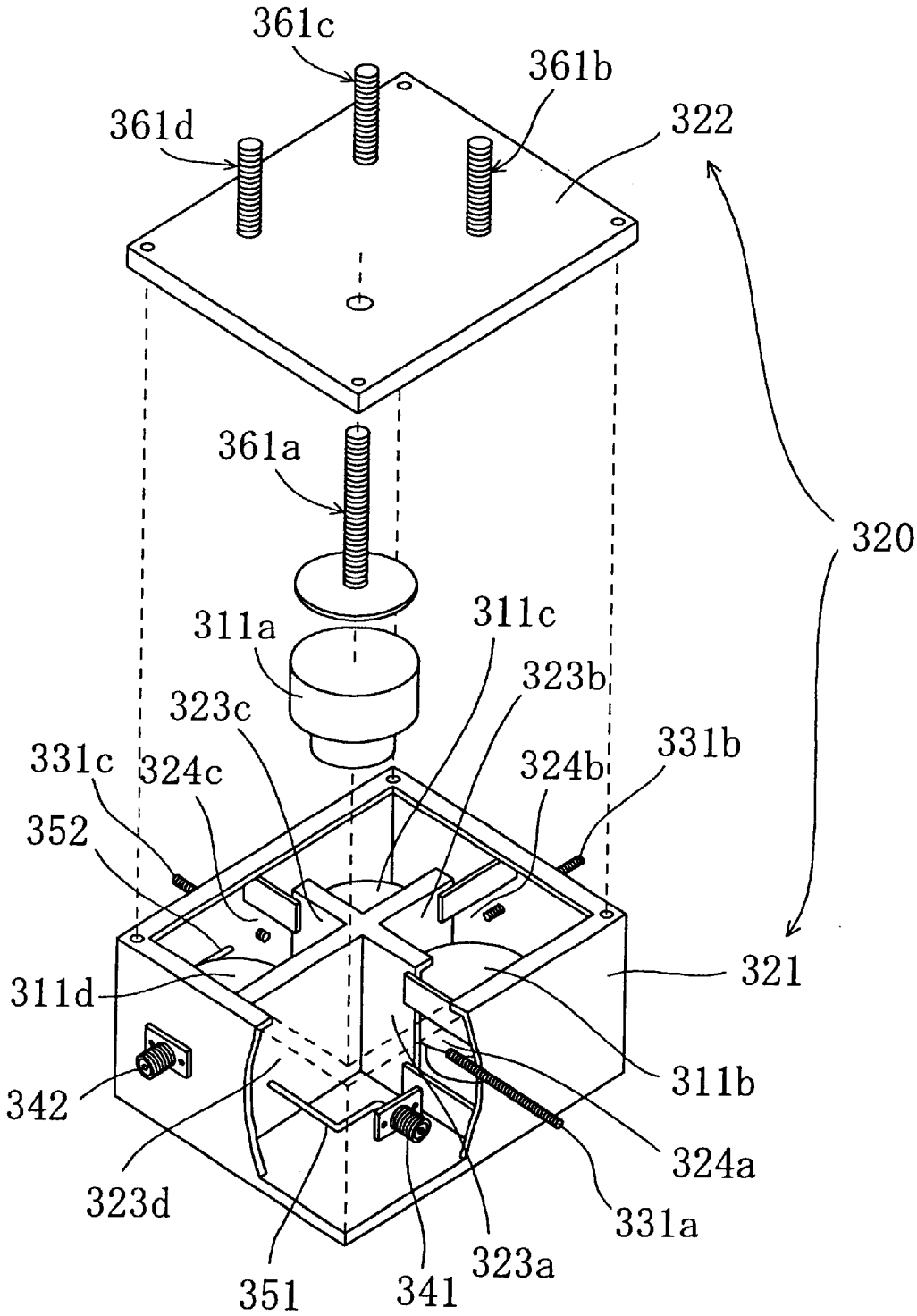
FIG. 19 is a perspective view schematically showing a structure of a dielectric resonator filter according to a seventh embodiment of the present invention.

FIG. 19 is a perspective view schematically showing a dielectric resonator filter according to a seventh embodiment of the present invention. As shown in FIG. 19, the dielectric resonator filter according to the present embodiment comprises four cylindrical dielectric resonators 311A to 311D formed by sintering a dielectric powder material. The resonance frequency of each of the dielectric resonators 311A to 311D is determined by the height and diameter of the cylindrical configuration thereof. In this example, the four dielectric resonators 311A to 311D operate as a four-stage band pass filter. An enclosure 320 of the dielectric resonator filter is composed of a main body 321, a lid 322, and partition walls 323A to 323D connected to each other to partition a space enclosed by the enclosure main body 321.

In the present embodiment, the interstage-coupling tuning windows 324A to 324C are not composed of cutaway portions formed directly in the partition walls 323A to 323C but are composed of pairs of upper and lower beams supported by the partition walls 323A to 323C. However, since the pairs of upper and lower beams also function as parts of the partition walls (interstage-coupling tuning plates), it is also possible to regard the interstage-coupling tuning windows 324A to 324C according to the present embodiment as cutaway portions formed in the partition walls, similarly to the fifth and sixth embodiments.

The dielectric resonators 311A to 311D are disposed on a one-by-one basis in four chambers defined by the partition walls 323A to 323C of the enclosure 320. The enclosure main body 321 is provided with an input terminal 341 and an output terminal 342 each composed of a coaxial connector to input and output a high-frequency signal to and from the outside. An input coupling probe 351 and an output coupling probe 352 are connected to the respective core conductors of the input and output terminals 341 and 342.

Resonance-frequency tuning members 361A to 361D each composed of a disk-shaped conductor plate and a bolt coupled integrally thereto to tune the resonance frequency of the corresponding one of the dielectric resonators 311A to 311D are attached to the enclosure lid 322. The resonance-frequency tuning members 361A to 361D are disposed to have their respective center axes at the same plan positions as the respective center axes of the dielectric resonators 311A to 311D (i.e., at the concentric positions). The structure and function of each of the resonance-frequency tuning members 361A to 361D are the same as in the fifth embodiment.

The dielectric resonator filter according to the present embodiment can be formed by, e.g., forming the partition walls 323A to 323D of the enclosure main body 321 integrally with the entire enclosure main body by an cutting operation, forming the upper and lower beams of conductor plates, and joining the upper and lower beams to the partition walls 323A to 323C. If the dielectric resonator is formed by a method in which the upper and lower beams are formed of copper thin plates and electrically joined by, e.g., lead soldering to the partition walls (interstage-coupling tuning plates), the upper and lower beams can easily be replaced with beams with different sizes and the configurations thereof can easily be changed by using a cutting tool such as a router. Even if the tuning of an interstage coupling using the interstage-coupling tuning bolts 151A to 151C is over the range in the structure shown in FIG. 12, the area of each of the interstage-coupling tuning windows 324A to 324C can easily be changed according to the present embodiment.

Thus, the dielectric resonator filter according to the present embodiment can widen the range of tuning of interstage coupling made by using the interstage-coupling tuning bolts 331*a* to 331*c* in addition to achieving the effects achieved by the fifth embodiment.

Embodiment 8

Figure 20:
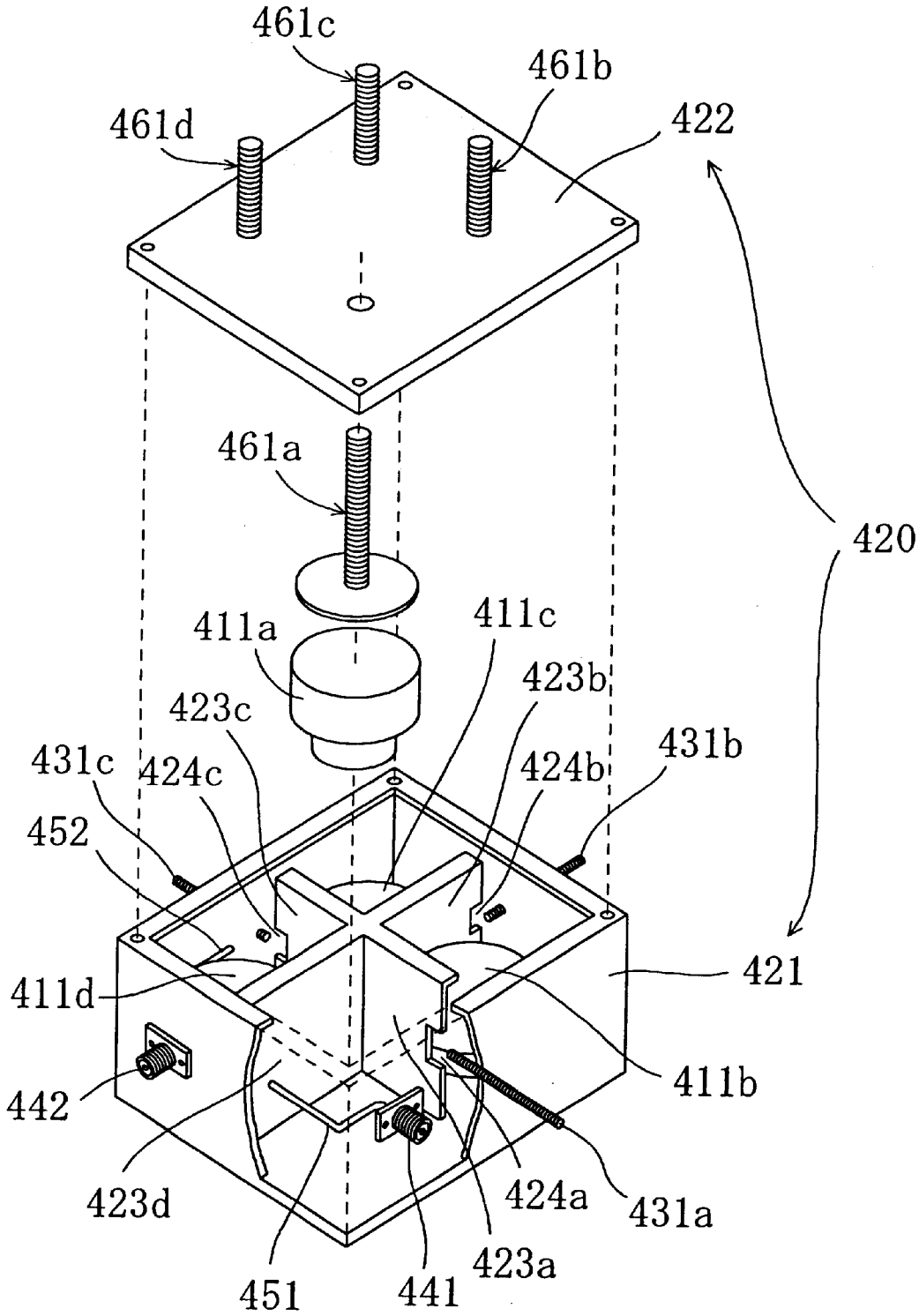
FIG. 20 is a perspective view schematically showing a structure of a dielectric resonator filter according to an eighth embodiment of the present invention.
Figure 21:
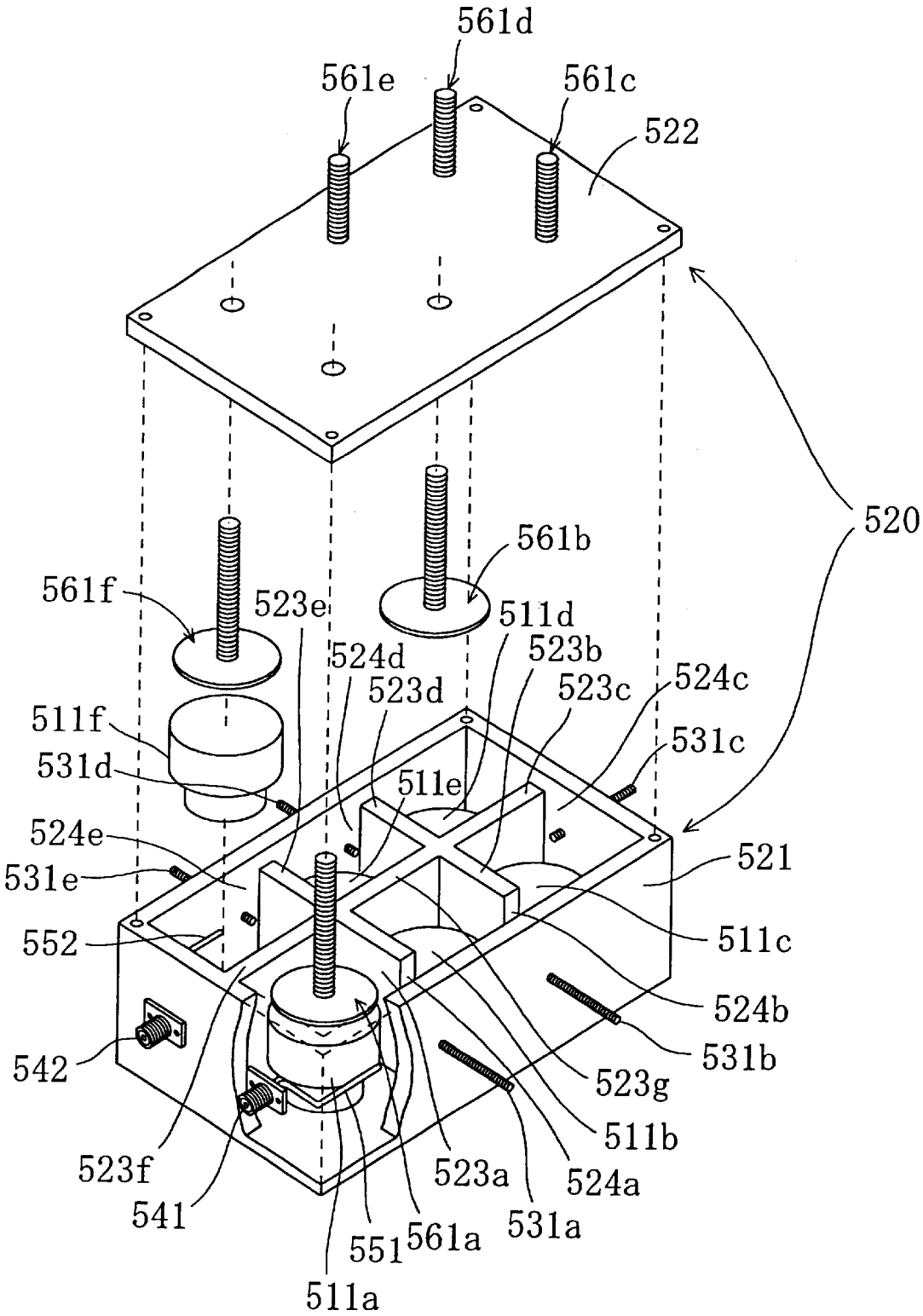
FIG. 21 PRIOR ART
FIG. 21 is a perspective view schematically showing an example of the conventional six-stage dielectric resonator filter.

FIG. 20 is a perspective view schematically showing a dielectric resonator filter according to an eighth embodiment of the present invention. As shown in FIG. 20, the dielectric resonator filter according to the present embodiment comprises four cylindrical dielectric resonators 411A to 411D formed by sintering a dielectric powder material. The resonance frequency of each of the dielectric resonators 411A to 411D is determined by the height and diameter of the cylindrical configuration thereof. In this example, the four dielectric resonators 411A to 411D operate as a four-stage band pass filter. An enclosure 420 of the dielectric resonator filter is composed of a main body 421, a lid 422, and partition walls 423A to 423D connected to each other to partition a space enclosed by the enclosure main body 421.

In the present embodiment, the three partition walls 423A to 423C of the partition plates 423A to 423D which function as interstage-coupling tuning plates are not in contact with the inner side surfaces of the enclosure main body 421 and spacings are provided therebetween. Electromagnetic field couplings between the dielectric resonators 441A to 441D are accomplished primarily through the spacings. The partition walls 423A to 423C are provided with cutaway portions for widening the movable ranges of interstage-coupling tuning bolts 431A to 431C. The spacings between the partition walls 423A to 423C and the inner side surfaces of the enclosure main body 421 and the cutaway portions compose interstage-coupling tuning windows 424A to 424C. In the present embodiment also, however, the function of tuning interstage couplings is substantially enhanced by the cutaway portions in the partition walls 423A to 423C, though the cutaway portions have their both side portions cut away.

The dielectric resonators 411A to 411D are disposed on a one-by-one basis in four chambers defined by the partition walls 423A to 423C of the enclosure 420. The enclosure main body 421 is provided with an input terminal 441 and an output terminal 442 each composed of a coaxial connector to input and output a high-frequency signal to and from the outside. An input coupling probe 451 and an output coupling probe 452 are connected to the respective core conductors of the input and output terminals 441 and 442.

Resonance-frequency tuning members 461A to 461D each composed of a disk-shaped conductor plate and a bolt coupled integrally thereto to tune the resonance frequency of the corresponding one of the dielectric resonators 411A to 411D are attached to the enclosure lid 422. The resonance-frequency tuning members 461A to 461D are disposed to have their respective center axes at the same plan positions as the respective center axes of the dielectric resonators 411A to 411D (i.e., at the concentric positions). The structure and function of each of the resonance-frequency tuning members 461A to 461D are the same as in the fifth embodiment.

Since the dielectric resonator filter according to the present embodiment widens the movable ranges of the interstage-coupling tuning bolts 431A to 431C, it achieves the effect of widening the range of tuning of an interstage coupling in addition to the effects achieved by the fifth embodiment.

Other Embodiments

Although each of the fifth to eighth embodiments has described, as an example of the dielectric resonator filter to which the present invention is applied, the multi-stage filter using the four dielectric resonators, the structure of the dielectric resonator filter according to the present invention is not limited to the foregoing embodiments. A dielectric resonator filter having stages other than six stages such as an eight- or four-stage dielectric resonator filter can also achieve the effects of the present invention.

Although each of the fifth to eighth embodiments has described, as an example of the dielectric resonator filter to which the present invention is applied, the band pass filter, the structure of the dielectric resonator filter according to the present invention is not limited to the foregoing embodiments. Another type of filter, e.g., a band stop filter can also achieve the effects of the present invention. It will easily be understood that, in that case, the effects of the present invention are achievable if the pass band according to the present invention is replaced with the stop band.

Although the interstage-coupling tuning windows composed of the cutaway portions in the partition walls functioning as the interstage-coupling tuning plates are configured to have equal sizes in each of the fifth to eighth embodiments, the configurations of the interstage-coupling tuning windows according to the present invention are not limited to the foregoing embodiments. It is also possible to form interstage-coupling tuning windows having different configurations in different partition walls.

Although the cutaway portions in the partition walls functioning as the interstage-coupling tuning plates are provided in the outer side surfaces of the partition walls in each of the fifth and sixth embodiments, the configurations of the interstage-coupling tuning windows according to the present invention are not limited to such embodiments. It is also possible to form cutaway portions in the inner walls surfaces of the partition walls and use the cutaway portions as the interstage-coupling tuning windows, as indicated by the broken lines in FIG. 12.

The sizes and positions of the cutaway portions (interstage-coupling tuning windows) are not limited to the ones shown as examples in the foregoing embodiments. The sizes and positions of the cutaway portions are determined by the required strengths of interstage couplings which can be determined selectively and appropriately depending on the specifications of the dielectric resonator filter, the design of the dielectric resonators, the setting of the movable ranges of the interstage-coupling tuning bolts, and the like.

What is claimed is:

1. A dielectric resonator filter comprising:

at least one dielectric resonator;

an enclosure enclosing the dielectric resonator to function as a shield against an electromagnetic field;

resonance-frequency tuning means including a conductor plate disposed in a space enclosed by the enclosure to have a first surface opposed to a surface of the dielectric resonator and a second surface opposed to an inner surface of the enclosure, the resonance-frequency tuning means being capable of changing the separation between the conductor plate and the dielectric resonator;

a rod for suppressing propagation of a spurious electromagnetic field mode produced in and around a space between the second surface of the conductor plate and the inner surface of the enclosure, said rod being supported by the conductor plate to fill part of the space defined by the conductor plate and the inner surface of the enclosure; and wherein said rod being independently adjustable within the space between the second surface of the conductor plate and the inner surface of the enclosure in relation to the resonance frequency tuning means.

2. The dielectric resonator filter of claim 1, wherein said rod is composed of a conductor material.

3. The dielectric resonator filter of claim 1, wherein said rod is composed of a dielectric material.

4. A dielectric resonator filter comprising:

at least one dielectric resonator;

an enclosure enclosing the dielectric resonator to function as a shield against an electromagnetic field;

resonance-frequency tuning means including a conductor plate disposed in a space enclosed by the enclosure to have a first surface opposed to a surface of the dielectric resonator and a second surface opposed to an inner surface of the enclosure, the resonance-frequency tuning means being capable of changing the separation between the conductor plate and the dielectric resonator;

a plate spring for suppressing propagation of a spurious electromagnetic field mode produced in and around a space between the second surface of the conductor plate and the inner surface of the enclosure, said plate spring being disposed between the second surface of the conductor plate and the inner surface of the enclosure and said plate spring substantially preventing said conductor plate from affecting the reduction of spurious mode; and wherein said plate spring automatically adjusts to span the space between the second surface of the conductor plate and the inner surface of the enclosure and thereby controlling the suppression of the spurious electromagnetic field mode without detaching said resonance-frequency tuning means from the enclosure.

5. The dielectric resonator filter of claim 3, wherein said plate spring comprising:

at least one bendable and flexible section, the section automatically adjusting to span the space between the second surface of the conductor plate and the inner surface of the enclosure.

6. The dielectric resonator filter of claim 3, wherein said plate spring is composed of a conductor material.

7. The dielectric resonator filter of claim 2, wherein said plate spring is composed of a dielectric material.

8. A dielectric resonator filter comprising:

at least one dielectric resonator;

an enclosure enclosing the dielectric resonator to function as a shield against an electromagnetic field;

resonance-frequency tuning means including a conductor plate disposed in a space enclosed by the enclosure to have a first surface opposed to a surface of the dielectric resonator and a second surface opposed to an inner surface of the enclosure, the resonance-frequency tuning means being capable of changing the separation between the conductor plate and the dielectric resonator; and a divided ring for suppressing propagation of a spurious electromagnetic field mode produced in and around a space between the second surface of the conductor plate and the inner surface of the enclosure, said divided ring being disposed between the second surface of the conductor plate and the inner surface of the enclosure, said divided ring capable of being detached and attached without requiring said resonance frequency means to be detached from the enclosure.

9. The dielectric resonator filter of claim 7, wherein said divided comprising:

at least two complementary sections, said sections capable of being attached or detached without requiring said resonance frequency means to be detached from the enclosure.

10. The dielectric resonator filter of claim 7, wherein said divided ring is composed of a conductor material.

11. The dielectric resonator filter of claim 7, wherein said divided ring is composed of a dielectric material.

* * * * *

UNITED STATES PATENT AND TRADEMARK OFFICE

CERTIFICATE OF CORRECTION

PATENT NO. : 6,642,815 B2
DATED : November 4, 2003
INVENTOR(S) : Okazaki et al.

It is certified that error appears in the above-identified patent and that said Letters Patent is hereby corrected as shown below:

Column 26,
Lines 20 and 26, “claim 3” should be -- claim 4 --
Line 28, “claim 2” should be -- claim 4 --
Lines 52, 58 and 60, “claim 7” should be -- claim 8 --
Line 53, “divided comprising” should be -- divided ring comprising --

Signed and Sealed this

Twenty-sixth Day of October, 2004

JON W. DUDAS
*Director of the United States Patent and Trademark Office*